US010909919B2

(12) United States Patent
Toyomura et al.

(10) Patent No.: US 10,909,919 B2
(45) Date of Patent: Feb. 2, 2021

(54) DISPLAY DEVICE, METHOD FOR DRIVING DISPLAY DEVICE, AND ELECTRONIC APPARATUS

(71) Applicant: Sony Corporation, Tokyo (JP)

(72) Inventors: Naobumi Toyomura, Kanagawa (JP); Yusuke Onoyama, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/972,515

(22) Filed: May 7, 2018

(65) Prior Publication Data

US 2018/0254008 A1 Sep. 6, 2018

Related U.S. Application Data

(63) Continuation of application No. 14/650,950, filed as application No. PCT/JP2013/079443 on Oct. 30, 2013, now abandoned.

(30) Foreign Application Priority Data

Dec. 26, 2012 (JP) ..... 2012-282701
Jun. 27, 2013 (JP) ..... 2013-134785

(51) Int. Cl.
*G09G 3/3233* (2016.01)
*G09G 3/3291* (2016.01)
*G09G 3/3266* (2016.01)

(52) U.S. Cl.
CPC ..... *G09G 3/3233* (2013.01); *G09G 3/3266* (2013.01); *G09G 3/3291* (2013.01); (Continued)

(58) Field of Classification Search
CPC ..... G09G 3/3233; G09G 3/3648
See application file for complete search history.

(56) References Cited

U.S. PATENT DOCUMENTS

2006/0170628 A1* 8/2006 Yamashita ..... G09G 3/3233 345/76
2009/0091562 A1 4/2009 Uchino et al.
(Continued)

FOREIGN PATENT DOCUMENTS

CN 101577083 A 11/2009
CN 102184965 A 9/2011
(Continued)

OTHER PUBLICATIONS

Office Action for JP Patent Application No. 2014-554208, dated Sep. 26, 2017, 5 pages of Office Action and 4 pages of English Translation.

(Continued)

*Primary Examiner* — Sepehr Azari
(74) *Attorney, Agent, or Firm* — Michael Best & Friedrich LLP

(57) ABSTRACT

Provided is a display device in which a pixel circuit is arranged, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential, the display device including: a current path that flows a current flowing in the driving transistor in a non-light emission period of the light emitting unit into a predetermined node.

20 Claims, 14 Drawing Sheets

(52) U.S. Cl.
CPC ..... *G09G 2300/0819* (2013.01); *G09G 2300/0852* (2013.01); *G09G 2300/0861* (2013.01); *G09G 2300/0876* (2013.01); *G09G 2310/0251* (2013.01); *G09G 2310/08* (2013.01); *G09G 2320/0233* (2013.01); *G09G 2320/043* (2013.01)

(56) References Cited

U.S. PATENT DOCUMENTS

| | | | | |
|---|---|---|---|---|
| 2009/0262102 | A1 | 10/2009 | Tanikame et al. | |
| 2010/0141626 | A1 | 6/2010 | Tomida et al. | |
| 2012/0019498 | A1 | 1/2012 | Jeong | |
| 2012/0105427 | A1 | 5/2012 | Senda | |
| 2012/0132791 | A1* | 5/2012 | Aoki ..... | G01J 1/44 250/214.1 |
| 2013/0092930 | A1 | 4/2013 | Kimura | |

FOREIGN PATENT DOCUMENTS

| | | | |
|---|---|---|---|
| JP | 2002-351401 | A | 12/2002 |
| JP | 2005-004173 | A | 1/2005 |
| JP | 2005-300700 | A | 10/2005 |
| JP | 2006-227237 | A | 8/2006 |
| JP | 2008-287141 | A | 11/2008 |
| JP | 2010-113226 | A | 5/2010 |
| JP | 2010-145579 | A | 7/2010 |
| JP | 2011-164134 | A | 8/2011 |
| JP | 2012-014136 | A | 1/2012 |
| JP | 2012-242772 | A | 10/2012 |
| KR | 20120009904 | A | 2/2012 |

OTHER PUBLICATIONS

Office Action for CN Patent Application No. 201380067144.2, dated Jun. 20, 2017, 07 pages of Office Action and 08 pages of English Translation.
Office Action for CN Patent Application No. 2013800671442, dated Nov. 11, 2016, 7 pages of Office Action and 7 pages of English Translation.
Chinese Office Action dated Feb. 15, 2019 for corresponding Chinese Application No. 2013800671442.
Japanese Office Action dated Mar. 5, 2019 for corresponding Japanese Application No. 2018-055076.
Japanese Office Action dated May 21, 2019 for corresponding Japanese Application No. 2018-055076.
Japanese Office Action dated Aug. 13, 2019 for corresponding Japanese Application No. 2018-055076 (4 pages).
Japanese Office Action dated Aug. 13, 2019 for corresponding Japanese Application No. 2018-055076 (2 page).
Korean Office Action dated Aug. 28, 2019 for corresponding Korean Application No. 10-2015-7014963.
U.S. Final Office Action dated Nov. 19, 2019 for related U.S. Appl. No. 14/650,950.
US Patent Office Non-Final Office Action dated Mar. 6, 2020 for related U.S. Appl. No. 14/650,950.

* cited by examiner

FIG. 12
FIG. 12A
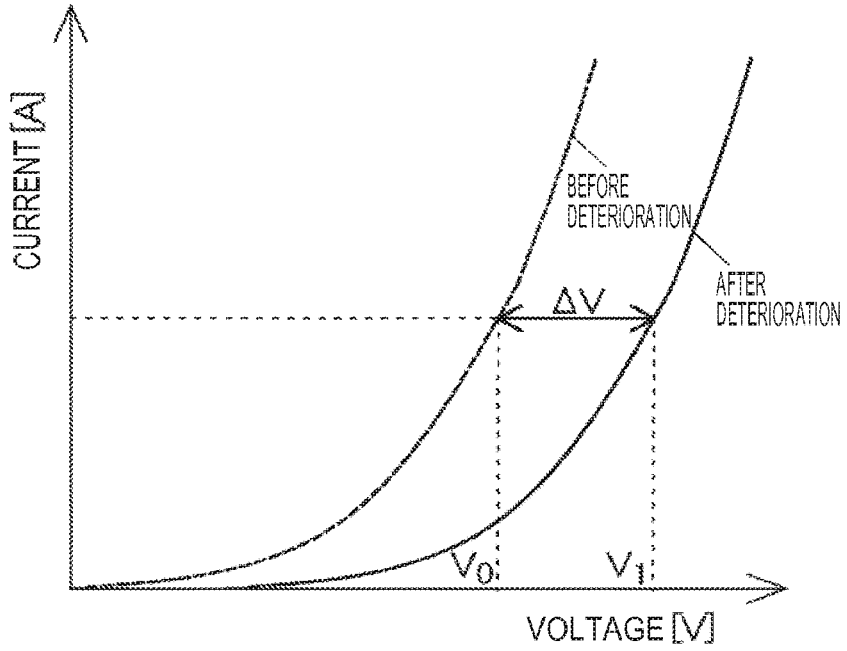
FIG. 12B
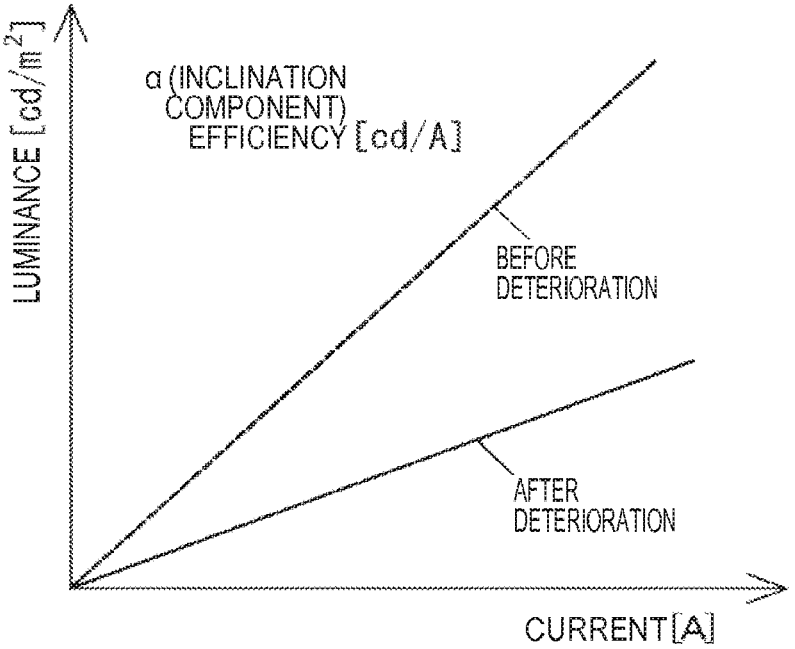

DISPLAY DEVICE, METHOD FOR DRIVING DISPLAY DEVICE, AND ELECTRONIC APPARATUS

CROSS REFERENCE TO RELATED APPLICATIONS

The present application is a Continuation Application of the patent application Ser. No. 14/650,950, filed Jun. 10, 2015, which is based on the priority applications JP-2013-134785 filed on Jun. 27, 2013 and JP-2012-282701 filed Dec. 26, 2012 and National Stage Application No.: PCT/JP2013/079443 filed on Oct. 30, 2013, the entire contents of which are incorporated herein by reference.

TECHNICAL FIELD

The present disclosure relates to a display device, a method for driving the display device, and an electronic apparatus, and more particularly to a plane type (flat panel type) display device in which pixels each including a light emitting unit are arranged in a matrix, a method for driving the display device, and an electronic apparatus having the display device.

BACKGROUND ART

One of the plane type display devices is a display device that uses a current drive type electric optical element as a light emitting unit of a pixel, in which the light emission luminance varies according to a current value flowing in the light emitting unit (light emitting element). As the current drive type electric optical element, for example, an organic EL element is known that utilizes a phenomenon that an organic thin film emits light by using electro luminescence (EL) of an organic material when an electric field is applied thereto.

Some of the plane type display devices as represented by this organic EL display device use a P channel type transistor as a driving transistor for driving the light emitting unit by a pixel circuit, and have a function of correcting variations in threshold voltage and mobility of the driving transistor. The pixel circuit has, in addition to the driving transistor, a sampling transistor, a switching transistor, a holding capacitor, and an auxiliary capacitor (see, for example, Patent Literature 1).

CITATION LIST

Patent Literature

Patent Literature 1: JP 2008-287141A

SUMMARY OF INVENTION

Technical Problem

In the display device according to the conventional example described above, when attention is focused on an operation point from a correction preparation period to a threshold correction period of a threshold voltage, anode potential of the light emitting unit exceeds the threshold voltage of the light emitting unit in spite of a non-light emission period. The light emitting unit thereby emits light at constant luminance for each frame regardless of gradation of a signal voltage in spite of the non-light emission period, resulting in a reduction in contrast of a display panel.

An object of the present disclosure is to provide a display device capable of surely controlling a light emitting unit into a non-light emission state in a non-light emitting period, a method for driving the display device, and an electronic apparatus having the display device.

Solution to Problem

In order to achieve the above object, according to the present disclosure, there is provided a display device in which a pixel circuit is arranged, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential, the display device including: a current path that flows a current flowing in the driving transistor in a non-light emission period of the light emitting unit into a predetermined node.

In order to achieve the above object, according to the present disclosure, there is provided a method for driving a display device. A pixel circuit is arranged in the display device, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential. The method includes: flowing, when driving the display device, a current flowing in the driving transistor in a non-light emission period of the light emitting unit into a predetermined node.

In order to achieve the above object, according to the present disclosure, there is provided an electronic apparatus including a display device in which a pixel circuit is arranged, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential, the display device including a current path that flows a current flowing in the driving transistor in a non-light emission period of the light emitting unit into a predetermined node.

Even when anode potential of a light emitting unit exceeds a threshold voltage of a light emitting unit in spite of a non-light emission period of the light emitting unit, allowing a current flowing in a driving transistor to flow into a predetermined node can prevent the current from flowing into the light emitting unit, thereby preventing the light emitting unit from emitting light in the non-light emission period.

Advantageous Effects of Invention

According to the present disclosure, the light emitting unit is surely controlled into a non-light emission state in the non-light emission period to prevent the light emitting unit from emitting light in the non-light emission period, thereby providing a display panel with high contrast.

BRIEF DESCRIPTION OF DRAWINGS

FIG. 12A is a diagram showing an I-V characteristic before deterioration and after deterioration of an organic EL element, and FIG. 12B is a diagram showing an I-L characteristic before deterioration and after deterioration of the organic EL element.

DESCRIPTION OF EMBODIMENTS

Figure 1:
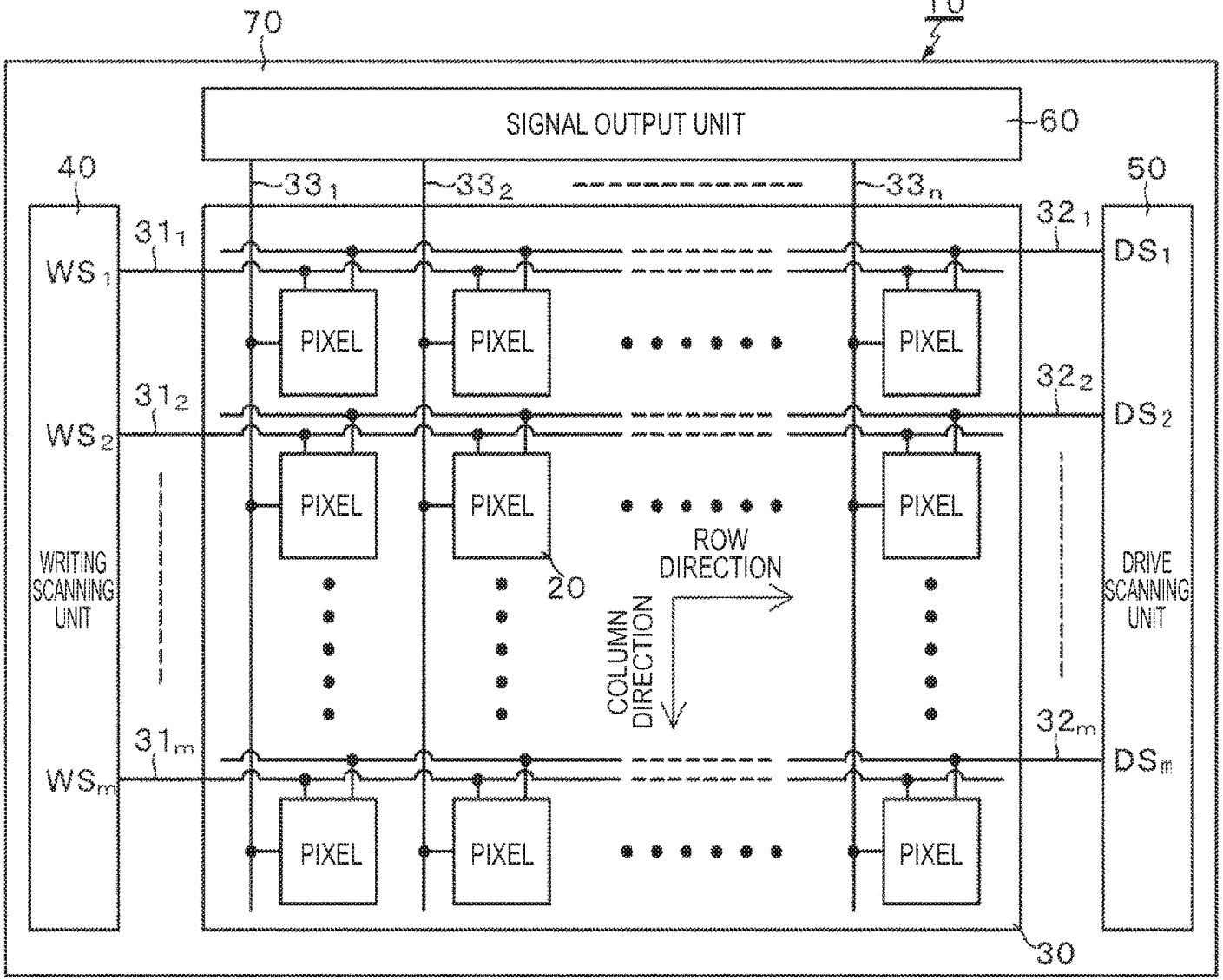
FIG. 1 is a system configuration diagram showing an outline of the basic configuration of an active matrix display device as a premise of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted. Note that description will be provided in the following order.

1. General explanation of display device, method for driving display device, and electronic apparatus according to the present disclosure
2. Active matrix display device as premise of the present disclosure
2-1. System configuration
2-2. Pixel circuit
2-3. Basic circuit operation
2-4. Troubles from threshold correction preparation period to threshold correction period
3. Explanation of embodiments
3-1. Embodiment 1
3-2. Embodiment 2
3-3. Embodiment 3
3-4. Embodiment 4
4. Application example
5. Electronic apparatus

1. General Explanation of Display Device, Method for Driving Display Device, and Electronic Apparatus According to the Present Disclosure A display device according to the present disclosure is a plane type (flat panel type) display device configured to arrange a pixel circuit having, in addition to a P channel type driving transistor for driving a light emitting unit, a sampling transistor, a light emission control transistor, a holding capacitor, and an auxiliary capacitor.

In the above-described pixel circuit, the sampling transistor writes a signal voltage into the holding capacitor by sampling the signal voltage. The light emission control transistor controls light emission/non-light emission of the light emitting unit. The holding capacitor is connected between a gate electrode and a source electrode of the driving transistor, and holds the signal voltage written by the sampling by the sampling transistor. The auxiliary capacitor is connected between the source electrode of the driving transistor and a node having fixed potential.

Examples of the plane type display device include an organic EL display device, a liquid crystal display device, a plasma display device, and the like. Among these display devices, the organic EL display device uses, as a light emitting element (electric optical element) of a pixel, an organic EL element that utilizes a phenomenon that an organic thin film emits light by using electro luminescence of an organic material when an electric field is applied thereto.

The organic EL display device in which an organic EL element is used as a light emitting unit of a pixel has the following characteristics. That is, the organic EL display device consumes low power because the organic EL element can be driven with an application voltage of 10 V or lower. Further, since the organic EL element is a self-luminescent element, the organic EL display device has a higher visibility of an image than a liquid crystal display device, which is a plane type display device as well as the organic EL display device. Further, the organic EL display device can be made light and thin easily because a lighting member such as a back light is unnecessary. Furthermore, since the response speed of the organic EL element is very fast, which is approximately several micro seconds, the organic EL display device does not generate an afterimage when displaying a moving image.

The organic EL element is a self-luminescent element and also a current-drive type electro-optical device. Examples of the current-drive type electro-optical device include, in addition to the organic EL element, an inorganic EL element, an LED element, a semiconductor laser element, and the like.

The planar type display device such as an organic EL display device may be used as a display unit (display device) in various electronic apparatuses including a display unit. Examples of the various electronic apparatuses include a head mounted display, a digital camera, a television system, a digital camera, a video camera, a game machine, a laptop personal computer, a mobile information device such as an c-book reader, a mobile communication device such as a personal digital assistant (PDA) or a cell phone, and the like.

The technology according to the present disclosure uses, as a premise, a P channel type transistor as the driving transistor. The reason for using the P channel type transistor instead of an N channel transistor as the driving transistor is as follows.

Assuming that a transistor is formed not on an insulator such as a glass substrate but on a semiconductor such as silicon, the transistor does not have three terminals of a source, a gate and a drain, but has four terminals of a source, a gate, a drain, and a back gate (base). Then, when the N channel type transistor is used as the driving transistor, back gate (substrate) potential becomes 0 V, resulting in an adverse effect on an operation for correcting variations in threshold voltage of the driving transistor for each pixel, and the like.

Further, compared with the N channel type transistor having a lightly doped drain (LDD) region, the P channel type transistor having no LDD region is small in variations in characteristics of the transistor, which is advantageous for miniaturization of a pixel, eventually, high definition of the display device. For such a reason, assuming that the transistor is formed on a semiconductor such as silicon, it is preferable that the P channel type transistor instead of the N channel type transistor is used as the driving transistor.

Accordingly, in the display device that uses the P channel type transistor as the driving transistor, the technology according to the present disclosure includes a current path allowing a current flowing in the driving transistor in a non-light emission period of the light emitting unit to flow into a predetermined node, or is configured to allow the current flowing in the driving transistor in the non-light emission period of the light emitting unit to flow into the predetermined node.

In the display device, a method for driving the display device, and an electric apparatus, including the preferable configuration described above, the current path allows the current flowing in the driving transistor to flow into a node of a cathode electrode of the light emitting unit. In this case, the current path allows a switching transistor to be connected between a drain electrode of the driving transistor and a node of a cathode electrode of the light emitting unit to bring the switching transistor into a conductive state in the non-light emission period of the light emitting unit.

Further, in the display device, the method for driving the display device, and the electric apparatus, including the preferable configuration described above, the switching transistor can be driven by a signal for driving the sampling transistor. In this case, the light emission period of the light emitting unit can be set as a period from timing when a signal for driving the light emission control transistor becomes active to timing when a signal for driving the sampling transistor becomes active. That is, the start of quenching of the light emitting unit can be determined by the timing when the signal for driving the sampling transistor becomes active.

Alternatively, in the display device, the method for driving the display device, and the electric apparatus, including the preferable configuration described above, the switching transistor can be driven by a signal different from the signal for driving the sampling transistor. In this case, the light emission period of the light emitting period can be set as a period from timing when the signal for driving the light emission control transistor becomes active to timing when the signal for driving the sampling transistor becomes active, or a period from timing when the signal for driving the light emission control transistor becomes active to timing when a signal for driving the switching transistor becomes active. That is, the start of quenching of the light emitting unit can be determined by the timing when the signal for driving the sampling transistor or the signal for driving the switching transistor becomes active.

Further, in the display device, the method for driving the display device, and the electric apparatus, including the preferable configuration described above, the signal for driving the switching transistor can enter a non-active state before a writing period of a signal voltage by the sampling transistor starts. The switching transistor thereby enters a non-conductive state before the writing period of the signal voltage starts, to cut off the current path.

Further, in the display device, the method for driving the display device, and the electric apparatus, including the preferable configuration described above, the sampling transistor, the light emission control transistor, and the switching transistor can be configured with a P channel type transistor being the same as the driving transistor.

Further, in the display device, the method for driving the display device, and the electric apparatus, including the preferable configuration described above, the pixel circuit can perform an operation of changing source potential of the driving transistor toward potential obtained by subtracting the threshold voltage of the driving transistor from an initial voltage of gate potential of the driving transistor as a reference.

Further, in the display device, the method for driving the display device, and the electric apparatus, including the preferable configuration described above, the pixel circuit can perform an operation of applying negative feedback to the holding capacitor in the writing period of the signal voltage by the sampling transistor, by using a feedback amount according to a current flowing in the driving transistor.

2. Active Matrix Display Device as Premise of the Present Disclosure

2-1. System Configuration

FIG. 1 is a system configuration diagram showing an outline of the basic configuration of an active matrix display device as a premise of the present disclosure. The active matrix display device as a premise of the present disclosure is also the active matrix display device according to the conventional example described in Patent Literature 1.

The active matrix display device is a display device that controls a current flowing into an electro-optical device by use of an active element provided in the same pixel circuit as the electro-optical device, such as an insulated gate field effect transistor. Typical examples of the insulated gate field effect transistor include a thin film transistor (TFT).

Here, the description is made by taking, as an example, a case of an active matrix organic EL display device in which an organic EL element, for example, which is a current-drive type electro-optical device in which the luminance changes in accordance with a current value flowing in the device, is used as a light emitting unit (light emitting element) in a pixel circuit. Note that, hereinafter, the "pixel circuit" may also be simply referred to as "pixel."

As shown in FIG. 1, the organic EL display device 10 as a premise of the present disclosure includes a pixel array unit 30 in which a plurality of pixels 20 each including an organic EL element are arranged two-dimensionally in matrix and a drive circuit unit (drive unit) disposed on the periphery of the pixel array unit 30. The drive circuit unit includes a writing scanning unit 40, a driving scanning unit 50, and a signal output unit 60, which are mounted on a same display panel 70 as the pixel array unit 30, and drives each of the pixels 20 of the pixel array unit 30, for example. Note that some or all of the writing scanning unit 40, the driving scanning unit 50, and the signal output unit 60 may be provided outside the display panel 70.

In a case in which the organic EL display device 10 is capable of color display, one pixel (unit pixel) serving as a unit of forming a color image includes a plurality of sub-pixels. In this case, each of the sub-pixels corresponds to each of the pixels 20 in FIG. 1. More specifically, in a display device capable of color display, for example, one pixel includes three sub-pixels: a sub-pixel that emits red (R) light, a sub-pixel that emits green (G) light, and a sub-pixel that emits blue (B) light.

However, the combination of sub-pixels in one pixel is not limited to three primary colors of RGB, but one pixel may include a sub-pixel of one more color or sub-pixels of plural colors in addition to the sub-pixels of three primary colors. More specifically, for example, one pixel may include a sub-pixel that emits white (W) light in order to increase the luminance, or may include at least one sub-pixel that emits light of a complementary color in order to enlarge the range of color reproduction.

In the pixel array unit 30, for the arrangement of pixels 20 having m rows and n columns, scanning lines 31 ($\mathbf{31}_1$ to $\mathbf{31}_m$) are arranged along a row direction (direction of the arrangement of pixels in a pixel row/horizontal direction), and driving lines 32 ($\mathbf{32}_1$ to $\mathbf{32}_m$) are arranged for each pixel row. Further, for the arrangement of pixels 20 having m rows and n columns, signal lines 33 ($\mathbf{33}_1$ to $\mathbf{33}_n$) are arranged for each pixel column along a column direction (direction of the arrangement of pixels in a pixel column/vertical direction).

The scanning lines $\mathbf{31}_1$ to $\mathbf{31}_m$ are each connected to an output terminal of a corresponding row of the writing scanning unit 40. The driving lines $\mathbf{32}_1$ to $\mathbf{32}_m$ are each connected to an output terminal of a corresponding row of the driving scanning unit 50. The signal lines $\mathbf{33}_1$ to $\mathbf{33}_n$ are each connected to an output terminal of a corresponding column of the signal output unit 60.

The writing scanning unit 40 is formed by a shift register circuit, for example. The writing scanning unit 40 scans each of the pixels 20 of the pixel array unit 30 sequentially in a row unit (that is, the writing scanning unit 40 performs line sequential scanning) by supplying writing scanning signals WS ($WS_1$ to $WS_m$) sequentially to the scanning lines 31 ($\mathbf{31}_1$ to $\mathbf{31}_m$) when writing a signal voltage of an image signal to each of the pixels 20 of the pixel array unit 30.

The driving scanning unit 50 is formed by a shift register circuit, for example, similarly to the writing scanning unit 40. The driving scanning unit 50 controls light emission/non-light emission (quenching) of the pixels 20 by supplying light emission control signals DS ($DS_1$ to $DS_m$) to the driving lines 32 ($\mathbf{32}_1$ to $\mathbf{32}_m$) in synchronization with the line sequential scanning performed by the writing scanning unit 40.

The signal output unit 60 selectively outputs a signal voltage $V_{sig}$ of an image signal (hereinafter also simply referred to as "signal voltage") in accordance with luminance information supplied from a signal supply source (not shown), a first reference voltage $V_{ref}$, and a second reference voltage $V_{ofs}$. Here, the first reference voltage $V_{ref}$ is a reference voltage for securely quenching the light emitting unit (organic EL element) of each of the pixels 20. Further, the second reference voltage $V_{ofs}$ is a voltage that corresponds to a voltage serving as a reference of the signal voltage $V_{sig}$ of the image signal (e.g., a voltage corresponding to a black level of the image signal), and is used when a threshold correction operation, which will be described later, is performed.

The signal voltage $V_{sig}$, the first reference voltage $V_{ref}$, and the second reference voltage $V_{ofs}$ outputted alternatively from the signal output unit 60 are written into each of the pixels 20 of the pixel array unit 30 through the signal lines 33 ($\mathbf{33}_1$ to $\mathbf{33}_n$), in a unit of a pixel row selected through the scanning performed by the writing scanning unit 40. That is, the signal output unit 60 employs a driving mode of line sequential writing in which the signal voltage $V_{sig}$ is written in a row (line) unit.

2-2. Pixel Circuit

Figure 2:
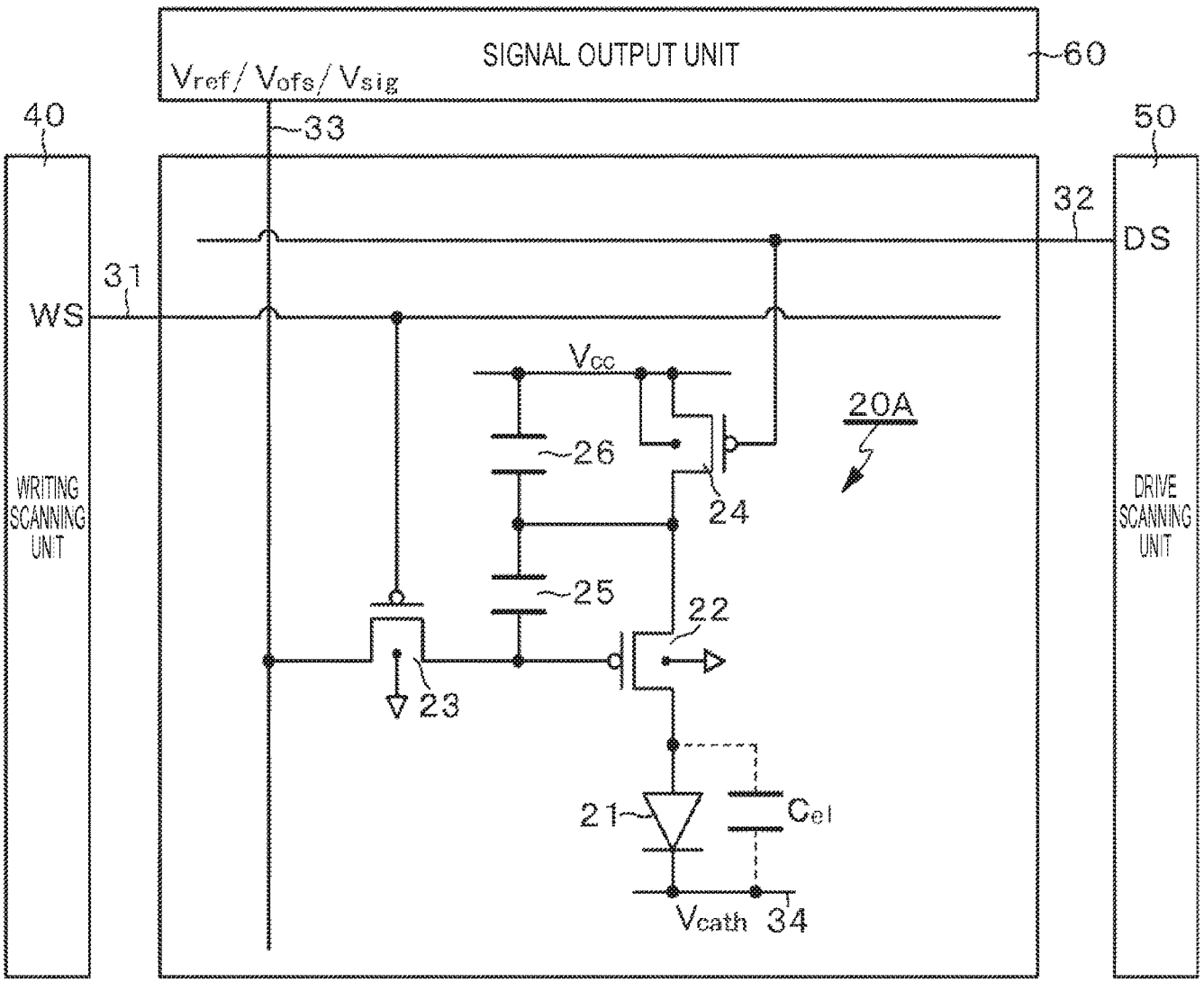
FIG. 2 is a circuit diagram showing a circuit example of a pixel (pixel circuit) in the active matrix display device as a premise of the present disclosure.

FIG. 2 is a circuit diagram showing a circuit example of the pixels (pixel circuits) in the active matrix display device as a premise of the present disclosure, that is, the active matrix display device according to the conventional example. The light emitting unit of each of the pixels $\mathbf{20}_A$ includes an organic EL element 21. The organic EL element 21 is an example of a current-drive type electro-optical device in which the luminance changes in accordance with a current value flowing in the device.

As shown in FIG. 2, the pixel $\mathbf{20}_A$ includes the organic EL element 21 and a drive circuit that drives the organic EL element 21 by supplying a current to the organic EL element 21. A cathode electrode of the organic EL element 21 is connected to a common power supply line 34 commonly arranged on all the pixels 20.

The drive circuit for driving the organic EL element 21 has a driving transistor 22, a sampling transistor 23, a light emission control transistor 24, a holding capacitor 25, and an auxiliary capacitor 26. Note that, assuming that the driving transistor 22 is formed on a semiconductor such as silicon instead of an insulator such as a glass substrate, as a premise, a P channel type transistor is used as the driving transistor 22.

Further, in this example, similarly to the driving transistor 22, the sampling transistor and the light emission control transistor 24 also use a P channel type transistor, assuming that they are formed on a semiconductor. Therefore, the driving transistor 22, the sampling transistor 23 and the light emission control transistor 24 do not have three terminals of a source, a gate and a drain, but have four terminals of a source, a gate, a drain and a back gate. A power supply voltage $V_{cc}$ is applied to the back gate.

In the pixel $\mathbf{20}_A$ having the above configuration, the sampling transistor 23 samples the signal voltage $V_{sig}$ supplied from the signal output unit 60 through the signal lines 33, thereby writing the signal voltage $V_{sig}$ to the holding capacitor 25. The light emission control transistor 24 is connected between a power source node of the power source voltage $V_{cc}$ and the source electrode of the driving transistor 22, and is driven by the light emission control signal DS to control the light emission/non-light-emission of the organic EL element 21.

The holding capacitor 25 is connected between the gate electrode of the driving transistor 22 and the source electrode of the driving transistor 22, and retains the signal voltage $V_{sig}$ written by sampling by the sampling transistor 23. The driving transistor 22 drives the organic EL element 21 by flowing the drive current, in accordance with the holding voltage of the holding capacitor 25, to the organic EL element 21. The auxiliary capacitor 26 is connected between the source electrode of the driving transistor 22 and a node at fixed potential, for example, the power source node of the power source voltage$_{cc}$. The auxiliary capacitor 26 makes an effect of suppressing variations in the source potential of the driving transistor 22 when the signal voltage $V_{sig}$ is written, and makes an effect of setting a gate-source voltage $V_{gs}$ of the driving transistor 22 at a threshold voltage $V_{th}$ of the driving transistor 22.

2-3. Basic Circuit Operation

Subsequently, a basic circuit operation of the active matrix organic EL display device 10 as a premise of the present disclosure, having the configuration described above, will be described by using the timing waveform diagram of FIG. 3.

Figure 3:
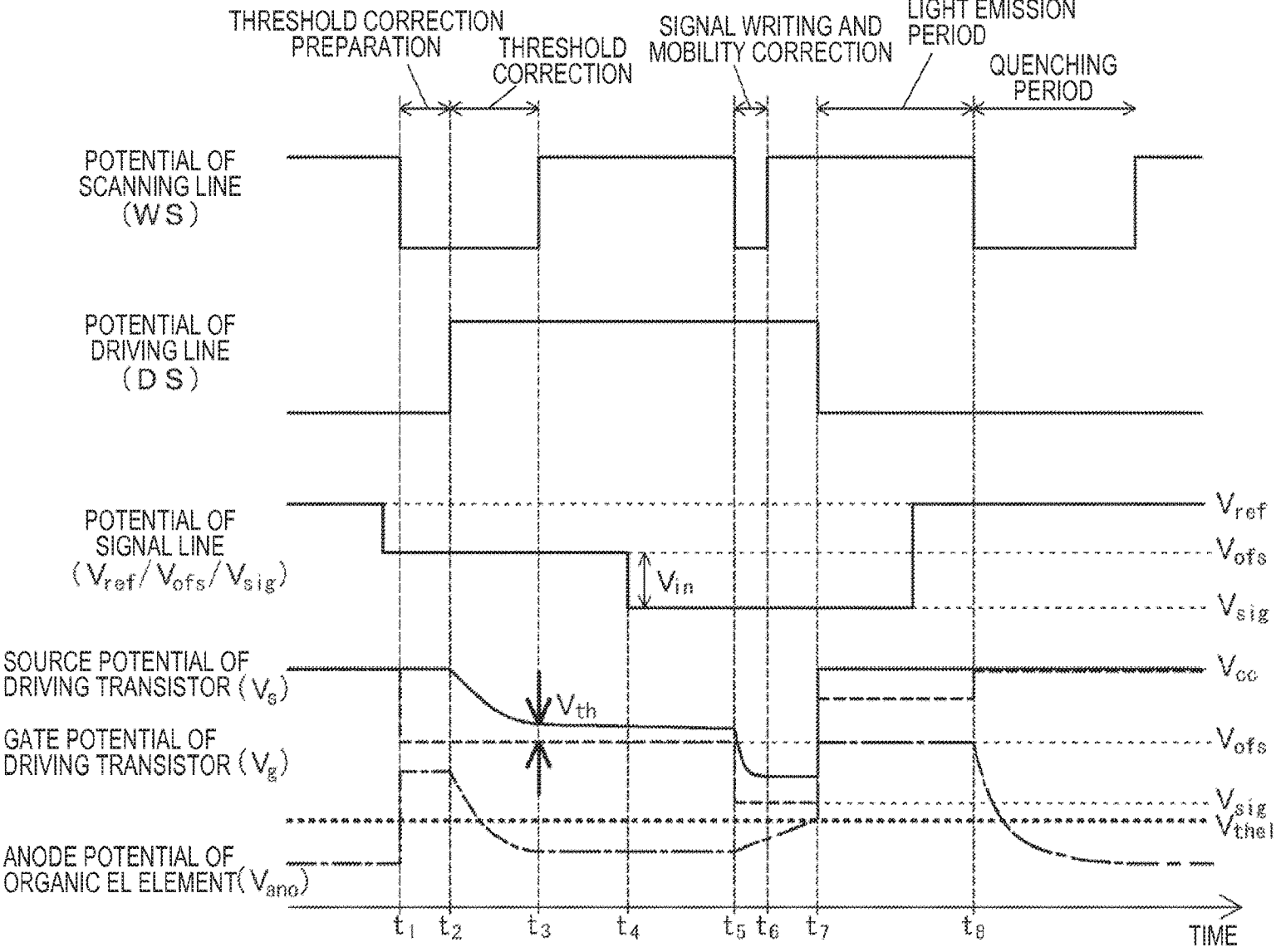
FIG. 3 is a timing waveform diagram for explaining a circuit operation of the active matrix display device as a premise of the present disclosure.

The timing waveform diagram of FIG. 3 shows a change in each of potential (a writing scanning signal) WS of a scanning line 31, potential (a light emission control signal) DS of a driving line 32, potential $V_{ref}/V_{ofs}/V_{sig}$ of a signal line 33, source potential $V_s$ and gate potential $V_g$ of the driving transistor 22, and anode potential $V_{ano}$ of the organic EL element 21.

Note that, since the sampling transistor 23 and the light emission control transistor 24 are a P channel type, a low potential state of the writing scanning signal WS and the light emission control signal DS means an active state, and a high potential state thereof means an non-active state, and the sampling transistor 23 and the light emission control transistor 24 enter a conductive state when the writing scanning signal WS and the light emission control signal DS are in an active state, and enter a non-active state when they are in a non-active state.

The end of the light emission period of the pixel $\mathbf{20}_A$, that is, the organic EL element 21 is determined by timing (the time $t_8$) when the potential WS of the scanning line 31 transits from high potential to low potential to bring the sampling transistor 23 into a conductive state. Specifically, when the potential WS of the scanning line 31 transits from high potential to low potential while the first reference voltage $V_{ref}$ is being outputted from the signal output unit 60 to the signal line 33, the gate-source voltage $V_{gs}$ of the driving transistor 22 becomes the threshold voltage $V_{th}$ of the driving transistor 22 or less to cut off the driving transistor 22.

When the driving transistor 22 is cut off, a current supply path to the organic EL element 21 is cut off to gradually decrease the anode potential $V_{ano}$ of the organic EL element 21. Then, when the anode potential $V_{ano}$ of the organic EL element 21 reaches a threshold voltage $V_{thel}$ of the organic EL element 21 or less, the organic EL element 21 enters a quenching state completely.

When the potential WS of the scanning line 31 transits from high potential to low potential at the time $t_1$, the sampling transistor 23 enters a conductive state. At this time, since the second reference voltage $V_{ofs}$ is being outputted from the signal output unit 60 to the signal line 33, the gate potential $V_g$ of the driving transistor 22 becomes the second reference voltage $V_{ofs}$.

Further, at the time $t_1$, since the potential DS of the driving line 32 is in a low potential state and the light emission control transistor 24 is in a conductive state, the source potential $V_5$ of the driving transistor 22 becomes the power supply voltage $V_{cc}$. At this time, the gate-source voltage $V_{gs}$ of the driving transistor 22 becomes $V_{gs}=V_{ofs}-V_{cc}$.

Here, in order to perform a threshold correction operation (threshold correction processing) to be described later, it is necessary to keep the gate-source voltage $V_{gs}$ of the driving transistor 22 higher than the threshold voltage $V_{th}$ of the driving transistor 22. Therefore, each voltage value is set so as to satisfy $|V_{gs}|=|V_{ofs}-V_{cc}|>|V_{th}|$.

In this manner, the initialization operation of setting the gate potential $V_g$ of the driving transistor 22 to the second reference voltage $V_{ofs}$, and setting the source potential $V_s$ of the driving transistor 22 to the power supply voltage $V_{cc}$ is an operation of preparation (threshold correction preparation) before performing the next threshold correction operation. Therefore, the second reference voltage $V_{ofs}$ and the power supply voltage $V_{cc}$ are initialization voltages of the gate potential $V_g$ and the source potential $V_s$ of the driving transistor 22, respectively.

Next, when the potential DS of the driving line 32 transits from low potential to high potential to bring the light emission control transistor 24 into a non-conductive state at the time $t_2$, the source potential $V_s$ of the driving transistor 22 enters a floating state to start the threshold correction operation while the gate potential $V_g$ of the driving transistor 22 is kept at the second reference voltage $V_{ofs}$. That is, the source potential $V_s$ of the driving transistor 22 starts descending (dropping) toward potential $(V_g-V_{th})$ obtained by subtracting the threshold voltage $V_{th}$ from the gate potential $V_g$ of the driving transistor 22.

In this manner, the operation of using the initialization voltage $V_{ofs}$ of the gate potential $V_g$ of the driving transistor 22 as a reference, and changing the source potential $V_s$ of the driving transistor 22 toward the potential $(V_g-V_{th})$ obtained by subtracting the threshold voltage $V_{th}$ from the initialization voltage $V_{ofs}$ is the threshold correction operation. The threshold correction operation progresses until the gate-source voltage $V_{gs}$ of the driving transistor 22 converges to the threshold voltage $V_{th}$ of the driving transistor 22. A voltage corresponding to the threshold voltage $V_{th}$ is held in the holding capacitor 25.

Then, when the potential WS of the scanning line 31 transits from low potential to high potential to bring the sampling transistor 23 into a non-conductive state at the time $t_3$, the threshold correction period ends. After that, at the time $t_4$, the signal voltage $V_{sig}$, of the image signal is outputted from the signal output unit 60 to the signal line 33 to switch the potential of the signal line 33 from the second reference voltage $V_{ofs}$ to the signal voltage $V_{sig}$.

Next, when the potential WS of the scanning line 31 transits from high potential to low potential to bring the sampling transistor 23 into a conductive state at the time $t_5$, the signal voltage $V_{sig}$ is written into the pixel $\mathbf{20}_A$ by sampling the signal voltage $V_{sig}$. The writing operation of the signal voltage $V_{sig}$ by the sampling transistor 23 allows the gate potential $V_g$ of the driving transistor 22 to be set to the signal voltage $V_{sig}$.

Upon the writing of the signal voltage $V_{sig}$ of the image signal, the auxiliary capacitor 26 connected between the source electrode of the driving transistor 22 and the power supply node of the power supply voltage $V_{cc}$ makes an effect of suppressing variations in the source potential $V_s$ of the driving transistor 22. When the driving transistor 22 is driven by the signal voltage $V_{sig}$ of the image signal, the threshold voltage $V_{th}$ of the driving transistor 22 is offset by the voltage corresponding to the threshold voltage $V_{th}$ held in the holding capacitor 25.

At this time, the gate-source voltage $V_{gs}$ of the driving transistor 22 is extended (increased) according to the signal voltage $V_{sig}$, but the source potential $V_s$ of the driving transistor 22 is still in a floating state. Therefore, the charged charge of the holding capacitor 25 is discharged according to the characteristics of the driving transistor 22. At this time, a current flowing in the driving transistor 22 starts charging an equivalent capacitor $C_{el}$ of the organic EL element 21.

When the equivalent capacitor $C_{el}$ of the organic EL element 21 is charged, the source potential $V_s$ of the driving transistor 22 gradually decreases with time. At this time, variations for each pixel in the threshold voltage $V_{th}$ of the driving transistor 22 are already canceled, and a drain-source current $I_{ds}$ of the driving transistor 22 depends on mobility u of the driving transistor 22. Note that the mobility u of the driving transistor 22 is mobility of a semiconductor thin film constituting a channel of the driving transistor 22.

Here, the decrease of the source potential $V_s$ of the driving transistor 22 acts so as to discharge the charged charge of the holding capacitor 25. That is, the decrease (change amount) of the source potential $V_s$ of the driving transistor 22 means that negative feedback is applied to the holding capacitor 25. Therefore, the decrease of the source potential $V_s$ of the driving transistor 22 corresponds to a feedback amount of the negative feedback.

In this manner, when the negative feedback is applied to the holding capacitor 25 by using the feedback amount according to the drain-source voltage $I_{ds}$ of the driving transistor 22, the dependency of the drain-source voltage $I_{ds}$ of the driving transistor 22 to the mobility u can be counteracted. This counteracting operation (counteracting processing) is a mobility correction operation (mobility correction processing) of correcting the variations for each pixel in the mobility u of the driving transistor 22.

More specifically, since the more signal amplitude $V_{in}$ ($=V_{sig}-V_{ofs}$) of the image signal written into the gate electrode of the driving transistor 22, the more the drain-source voltage $I_{ds}$, an absolute value of the feedback amount of the negative feedback is also increased. Therefore, the mobility correction operation is performed according to the signal amplitude $V_{in}$ of the image signal, that is, a light emission luminance level. Further, since, when the signal amplitude $V_{in}$ of the image signal is constant, the more the mobility u of the driving transistor 22, the more the absolute value of the feedback amount of the negative feedback, the variations for each pixel in the mobility u can be removed.

When the potential WS of the scanning line 31 transits from low potential to high potential to bring the sampling transistor 23 into a non-conductive state at the time $t_6$, the signal writing and mobility correction period ends. After the mobility correction is performed, when the potential DS of the driving line 32 transits from high potential to low potential at the time $t_7$, the light emission transistor 24 enters a conductive state. Accordingly, a current is supplied to the driving transistor 22 from the power supply node of the power supply $V_{cc}$ through the light emission control transistor 24.

At this time, since the sampling transistor 23 is in a non-conductive state, the gate electrode of the driving transistor 22 is electrically separated from the signal line 33 to be in a floating state. Here, when the gate electrode of the driving transistor 22 is in a floating state, since the holding capacitor 25 is connected between the gate and the source of the driving transistor 22, the gate potential $V_g$ varies in conjunction with variations in the source potential $V_s$ of the driving transistor 22.

That is, the source potential $V_s$ and the gate potential $V_g$ of the driving transistor 22 increase while holding the gate-source voltage $V_{gs}$ held in the holding capacitor 25. Also, the source potential $V_s$ of the driving transistor 22 increases to a light emission voltage $V_{oled}$ of the organic EL element 21 according to a saturated current of the transistor.

In this manner, the operation in which the gate potential $V_g$ varies in conjunction with variations in the source potential $V_s$ of the driving transistor 22 is a bootstrap operation. That is, the bootstrap operation is an operation in which the source potential $V_s$ and the gate potential $V_g$ of the driving transistor 22 vary while holding the gate-source voltage $V_{gs}$ held in the holding capacitor 25, that is, a both-end voltage of the holding capacitor 25.

Then, when the drain-source current $I_{ds}$ of the driving transistor 22 starts flowing in the organic EL element 21, the anode potential $V_{ano}$ of the organic EL element 21 increases according to the current $I_{ds}$. When the anode potential $V_{ano}$ of the organic EL element 21 exceeds the threshold voltage $V_{thel}$ of the organic EL element 21 over time, the driving current starts flowing in the organic EL element 21 to allow the organic EL element 21 to start emitting light.

In the series of circuit operations described above, each operation of the threshold correction preparation, the threshold correction, the writing of the signal voltage $V_{sig}$ (signal writing), and the mobility correction is executed, for example, in 1 horizontal period (1H).

Note that there has been described here, as an example, a case of applying a driving method in which the threshold correction processing is executed only once, but this driving method is merely an example and is not limited. For example, it is also possible to apply a driving method of performing division threshold correction in which, in addition to a 1H period in which the threshold correction is performed along with the mobility correction and signal writing, the threshold correction is dividedly executed a plurality of times over a plurality of horizontal periods preceding the 1H period.

According to the driving method of the division threshold correction, even when a time allocated as the 1 horizontal period is reduced by multi-pixels due to high definition, a sufficient time can be secured over the plurality of horizontal periods as the threshold correction period. Therefore, since, even when a time allocated as the 1 horizontal period is reduced, a sufficient time can be secured as the threshold correction period, the threshold correction processing can be surely executed.

2-4. Troubles from Threshold Correction Preparation Period to Threshold Correction Period Here, attention is focused on an operation point from threshold correction preparation period to the threshold correction period (the time $t_1$ to the time $t_3$). As is evident from the operation explanation described above, it is necessary to make the gate-source voltage $V_{gs}$ of the driving transistor 22 higher than the threshold voltage $V_{th}$ of the driving transistor 22 in order to perform the threshold correction operation.

This allows a current to flow in the driving transistor 22, and, as shown in the timing waveform diagram of FIG. 3, the anode potential $V_{ano}$ of the organic EL element 21 temporarily exceeds the threshold voltage $V_{thel}$ of the organic EL element 21 from the threshold correction preparation period to a part of the threshold correction period. This allows a current to flow into the organic EL element 21 from the driving transistor 22, thereby allowing the light emission unit (organic EL element 21) to emit light for each frame and at constant luminance regardless of gradation of the signal voltage $V_{sig}$ in spite of the non-light emission period. As a result, the contrast of the display panel 70 is reduced.

3. Explanation of Embodiments

Accordingly, in an embodiment according to the present disclosure, there is provided a current path allowing a current flowing in a driving transistor 22 to flow into a predetermined node in a non-light emission period of an organic EL element 21 as a light emitting unit. That is, the current flowing in the driving transistor 22 in the non-light emission period is made to forcibly flow into the predetermined node through the current path.

The application of the configuration described above, even when the current flows in the driving transistor 22 in the non-light emission period of the organic EL element 21, can prevent the current from flowing into the organic EL element 21 by flowing the current flowing in the driving transistor 22 into the predetermined node. This can prevent the organic EL element 21 from emitting light in the non-light emission period, thereby providing a display panel 70 with high contrast.

Hereinafter, there will be described specific embodiments for suppressing light emission of the organic EL element 21 in the non-light emission period.

3-1. Embodiment 1

Figure 4:
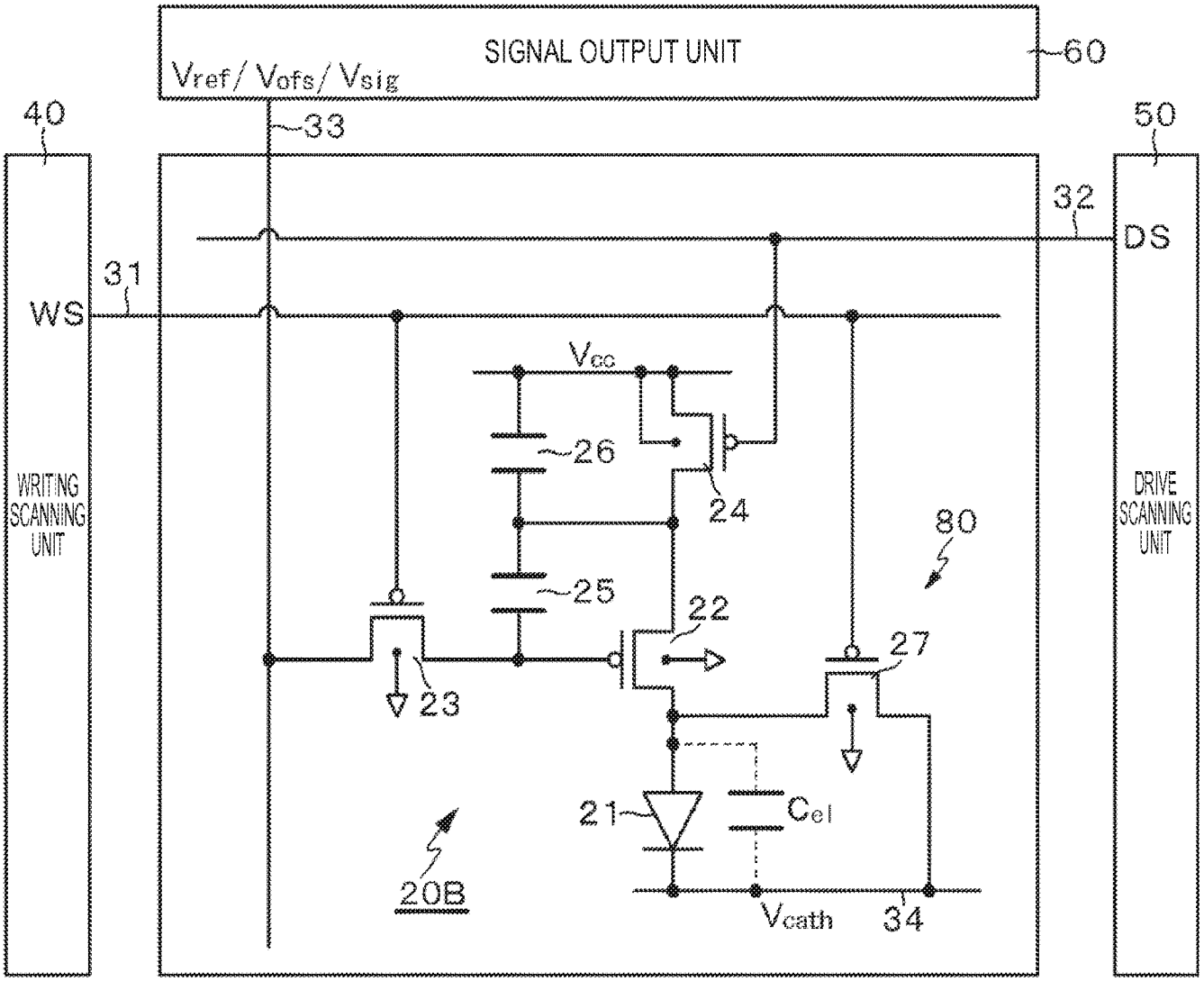
FIG. 4 is a circuit diagram showing a circuit example of a pixel (pixel circuit) according to Embodiment 1.

FIG. 4 is a circuit diagram showing a circuit example of a pixel (pixel circuit) according to Embodiment 1 and, in the figure, structural elements that have substantially the same element and function as FIG. 2 are denoted with the same reference numerals.

As shown in FIG. 4, a pixel $\mathbf{20}_B$ according to Embodiment 1 includes circuit elements constituting a circuit for driving an organic EL element 21, that is, a driving transistor 22, a sampling transistor 23, a light emission transistor 24, a holding capacitor 25, an auxiliary capacitor 26, and, in addition thereto, a current path 80.

The current path 80 is provided for allowing a current flowing in the driving transistor 22 to flow into a predetermined node, for example, a common power supply line 34 to which a cathode electrode of the organic EL element 21 is connected, in a non-light emission period of the organic EL element 21. The current path 80 is configured with a switch element, for example, a switching transistor 27. The switching transistor 27 is connected between a common connection node of a drain electrode of the driving transistor 22 and an anode electrode of the organic EL element 21, and the common power supply line 34 as an example of the predetermined node.

The switching transistor 27 is formed of a P channel type transistor which is the same conductive type as the driving transistor 22, the sampling transistor 23, and the light emission control transistor 24, and a gate electrode thereof is connected to a scanning line 31. That is, the switching transistor 27 is driven by a writing scanning signal WS given from a writing scanning unit 40 through the scanning line 31 to enter a conductive state in synchronization with a conduction operation of the sampling transistor 23.

A basic circuit operation of an active matrix display device including the pixel $\mathbf{20}_B$ having the configuration described above according to Embodiment 1 is similar to the active matrix organic EL display device 10 as a premise of the present disclosure described above, except for a circuit operation from a threshold correction preparation period to a threshold correction period.

Figure 5:
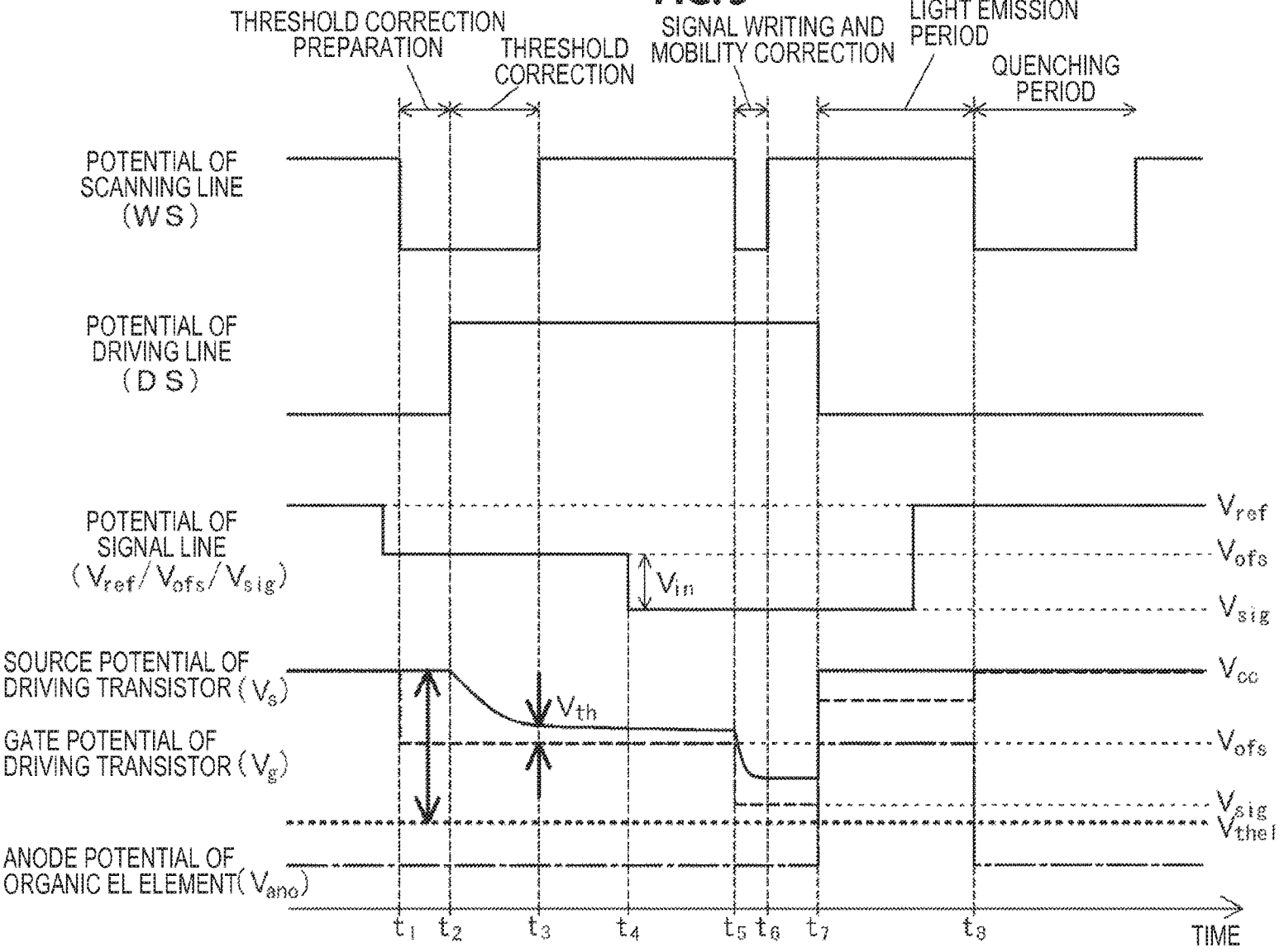
FIG. 5 is a timing waveform diagram for explaining a circuit operation of an active matrix display device including the pixel according to Embodiment 1.

Here, there will be mainly described using the timing waveform diagram of FIG. 5 the circuit operation different from that of the active matrix organic EL display device 10 as a premise of the present disclosure, that is, the circuit operation from the threshold correction preparation period to the threshold correction period. FIG. 5 is the timing waveform diagram for explaining the circuit operation of the active matrix display device including the pixel according to Embodiment 1.

When potential WS of the scanning line 31 transits from high potential to low potential at the time $t_1$, the sampling transistor 23 enters a conductive state. At this time, since potential of a signal line 33 is a second reference voltage $V_{ofs}$, gate potential $V_g$ of the driving transistor 22 becomes the second reference voltage $V_{ofs}$, and since the light emission transistor 24 is in a conductive state, source potential $V_s$ of the driving transistor 22 becomes a power supply voltage $V_{cc}$.

That is, when potential DS of a driving line 32 is in a low potential state, and the potential WS of the scanning line 31 transits from high potential to low potential, there is performed an threshold correction preparation operation of initializing the gate potential $V_g$ of the driving transistor 22 to the second reference voltage $V_{ofs}$, and the source potential $V_s$ of the driving transistor 22 to the power supply voltage $V_{cc}$, respectively.

The threshold correction preparation operation, that is, the initialization operation of the gate potential $V_g$ and the source potential $V_s$ of the driving transistor 22 makes a gate-source voltage $V_{gs}$ of the driving transistor 22 larger than a threshold voltage $V_{th}$ of the driving transistor 22. This is because a threshold correction operation cannot be normally performed if the gate-source voltage $V_{gs}$ of the driving transistor 22 is not made larger than the threshold voltage $V_{th}$ of the driving transistor 22.

When the initialization operation described above is performed, since anode potential $V_{ano}$ of the organic EL element 21 exceeds a threshold voltage of the organic EL element 21 in spite of a non-light emission period of the organic EL element 21, a current flows into the organic EL element 21 from the driving transistor 22. At this time, as described above, in spite of the non-light emission period of the organic EL element 21, the organic EL element 21 emits light for each frame and at constant luminance regardless of gradation of a signal voltage $V_{sig}$, which is also the problem of the related art.

In contrast, in the pixel $\mathbf{20}_B$ according to Embodiment 1, when the potential WS of the scanning line 31 transits from high potential to low potential at the time $t_1$, the switching transistor 27 of the current path 80 enters a conductive state. An electric short circuit between an anode electrode of the organic EL element 21 and a common power supply line 34 is thereby created through the switching transistor 27. Here, the on-resistance of the switching transistor 27 is much smaller than that of the organic EL element 21, thus allowing a current flowing in the driving transistor 22 to forcibly flow into the common power supply line 34.

In this manner, the current flowing in the driving transistor 22 due to the initialization operation as the threshold correction preparation operation is made to forcibly flow into the common power supply line 34 in the non-light emission period of the organic EL element 21, which can prevent the current from flowing into the organic EL element 21. Accordingly, it is possible to surely control the organic EL element 21 into a non-light emission state to prevent the organic EL element 21 from emitting light in the non-light emission period, thereby providing a display panel 70 with high contrast.

Further, the application of the configuration of creating the short circuit between the anode electrode of the organic EL element 21 and the common power supply line 34 allows the anode potential $V_{ano}$ of the organic EL element 21 to be potential of the common power supply line 34, that is, cathode potential $V_{cath}$ of the organic EL element 21. This makes a drain-source voltage of the driving transistor 22 in the threshold correction operation larger than that when no short circuit is created between the anode electrode of the organic EL element 21 and the common power supply line 34.

That is, the current value flowing in the driving transistor 22 in the threshold correction operation becomes larger than that when no short circuit is created between the anode electrode of the organic EL element 21 and the common power supply line 34, allowing the threshold correction operation to proceed faster. As a result, variations for each pixel in the threshold voltage $V_{th}$ of the driving transistor 22 can be corrected more securely, contributing to an increase in margin of drive timing.

Further, in the pixel $\mathbf{20}_B$ according to Embodiment 1, the writing scanning signal WS for driving the sampling transistor 23 is also used as a drive signal for the switching transistor 27. Therefore, a desired object can be achieved without an increase in circuit size of a pixel array unit 30. That is, the control for suppressing light emission of the organic EL element 21 in the non-light emission period can be performed with a simple configuration of only adding the switching transistor 27 to the pixel array unit 30, without the need for adding a scanning unit for generating the drive signal of the switching transistor 27 and wiring for transmitting the drive signal.

Note that, in the pixel $\mathbf{20}_B$ according to Embodiment 1, as is evident from the timing waveform of FIG. 5, the light emission period is set as a period from the time $t_7$ when a light emission control signal DS for driving the light emission control transistor 24 enters an active state, to the time $t_8$ when the writing scanning signal WS for driving the sampling transistor 23 enters an active state. Therefore, the start of quenching is determined by the timing (time $t_8$) when the writing scanning signal WS enters an active state.

3-2. Embodiment 2

Figure 6:
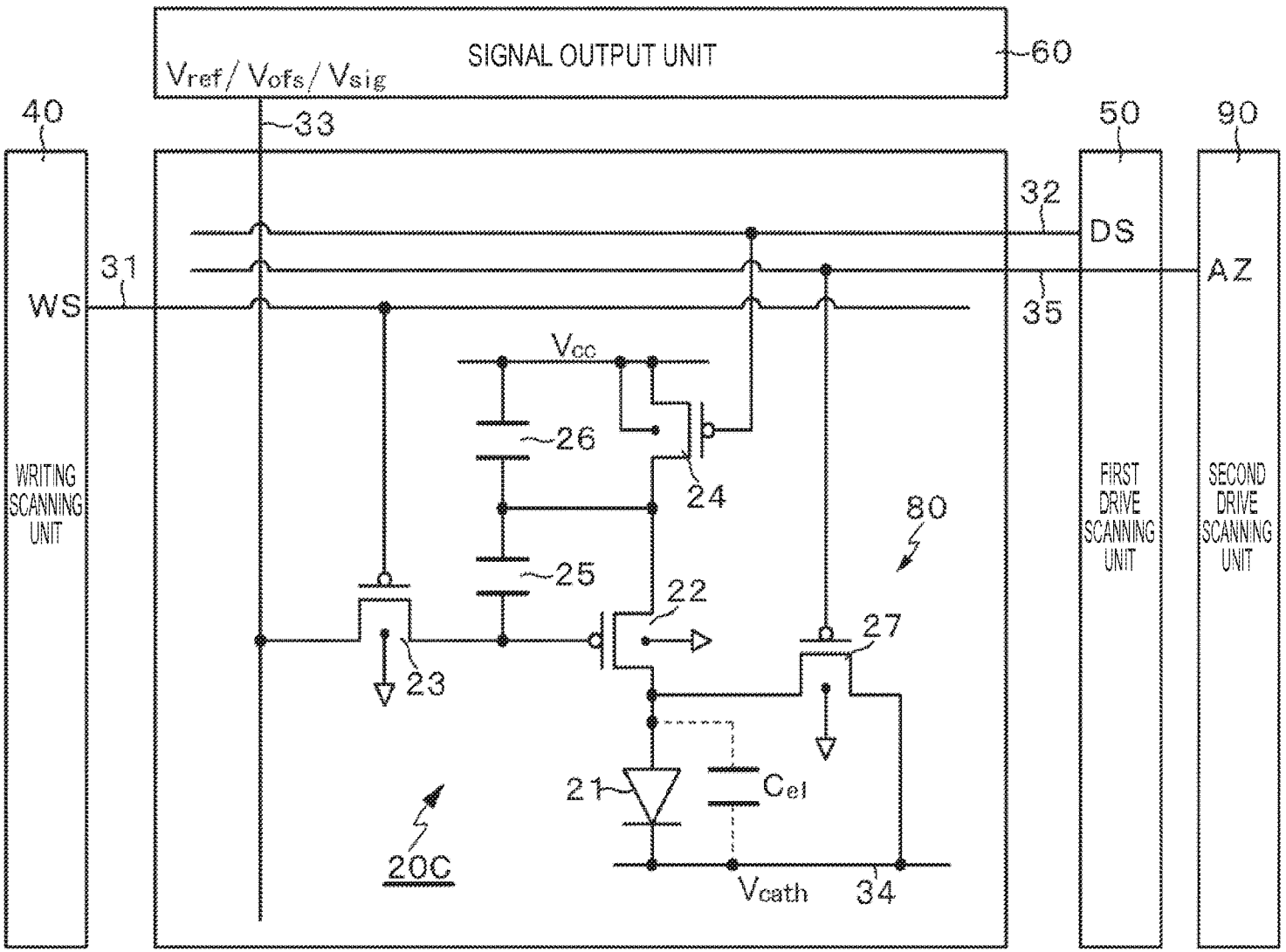
FIG. 6 is a diagram showing an outline of a circuit example of a pixel (pixel circuit) according to Embodiment 2, and an active matrix display device including the pixel.

FIG. 6 is a circuit diagram showing a circuit example of a pixel (pixel circuit) according to Embodiment 2 and, in the figure, structural elements that have substantially the same element and function as FIG. 2 are denoted with the same reference numerals.

As shown in FIG. 6, similarly to the pixel $\mathbf{20}_B$ according to Embodiment 1, a pixel $\mathbf{20}_C$ according to Embodiment 2 is also configured with a switching transistor 27 connected between a common connection node of a drain electrode of a driving transistor 22 and an anode electrode of an organic EL element 21, and a node of a common power supply line 34.

Note that, in the pixel $\mathbf{20}_B$ according to Embodiment 1, the writing scanning signal WS for driving the sampling transistor 23 is also used as the drive signal for the switching transistor 27, whereas, in the pixel $\mathbf{20}_C$ according to Embodiment 2, a signal different from the writing scanning signal WS is used as a drive signal for a switching transistor 27.

Specifically, as a peripheral circuit of a pixel array unit 30, in addition to a writing scanning unit 40 for outputting a writing scanning signal WS and a first drive scanning unit 50 for outputting a light emission control signal DS, a second drive scanning unit 90 for outputting a drive signal AZ is newly provided. And the drive signal AZ outputted from the second drive scanning unit 90 is given to a gate electrode of the switching transistor 27 through a driving line 35.

Figure 7:
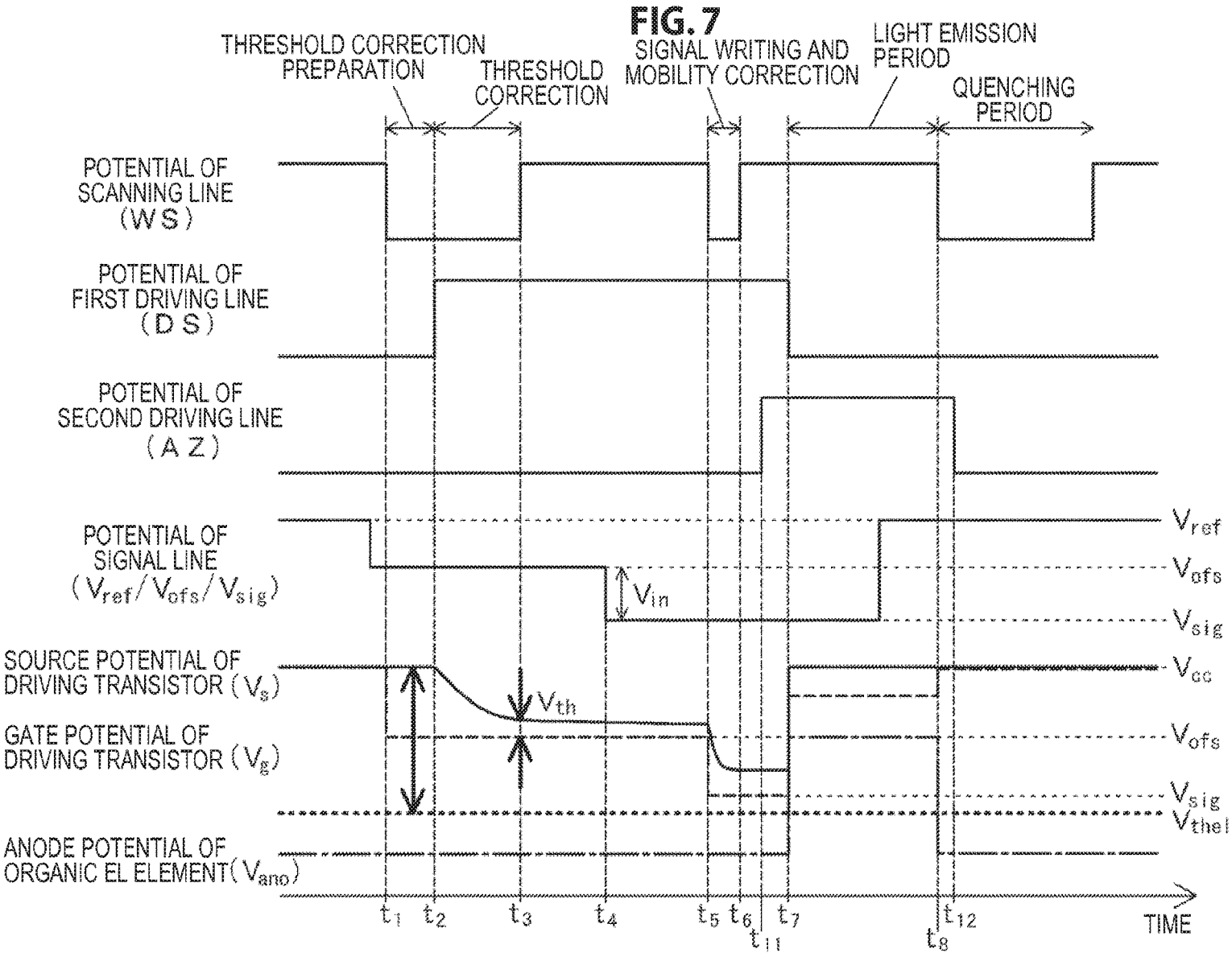
FIG. 7 is a timing waveform diagram for explaining a circuit operation of the active matrix display device including the pixel according to Embodiment 2.

The drive signal AZ for driving the switching transistor 27 is a signal which is in a non-active (high potential) state in a period including a light emission period of the organic EL element 21 and a period before and after the light emission period, and in an active (low potential) state in a period other than the period. Specifically, as shown in the timing waveform of FIG. 7, the drive signal AZ is in a non-active state only in a period from the time $t_{11}$ between the time $t_6$ to the time $t_7$, to the time $t_{12}$ after the time $t_8$.

When the switching transistor 27 is driven by the writing scanning signal WS as with the pixel $\mathbf{20}_B$ according to Embodiment 1, a trouble may occur when the threshold correction operation does not finish within an active period of the writing scanning signal WS. That is, if the gate-source voltage $V_{gs}$ of the driving transistor 22 does not converge to the threshold voltage $V_{th}$ within an active period of the writing scanning signal WS, the current flows from the driving transistor 22 to the organic EL element 21 after the switching transistor 27 transits from a conductive state to a non-conductive state, causing the organic EL element 21 to emit light.

In contrast, in the pixel 20C according to Embodiment 2, an active period of the drive signal AZ can be optionally set by using the drive signal AZ different from the writing scanning signal WS as a drive signal for driving the switching transistor 27. Further, it is possible to prevent a current from flowing in the organic EL element 21 even when a threshold correction period does not finish within a threshold correction period, by setting the drive signal AZ as a signal which is in an active state still after the threshold correction period, that is, after the time $t_3$.

Note that, in Embodiment 2, since the drive signal AZ is a signal which is in a non-active state only in the period from the time $t_{11}$ between the time $t_6$ to the time $t_7$, to the time $t_{12}$ after the time $t_8$, the start of quenching is determined by the timing (time $t_8$) when the writing scanning signal WS enters an active state.

3-3. Embodiment 3

Figure 8:
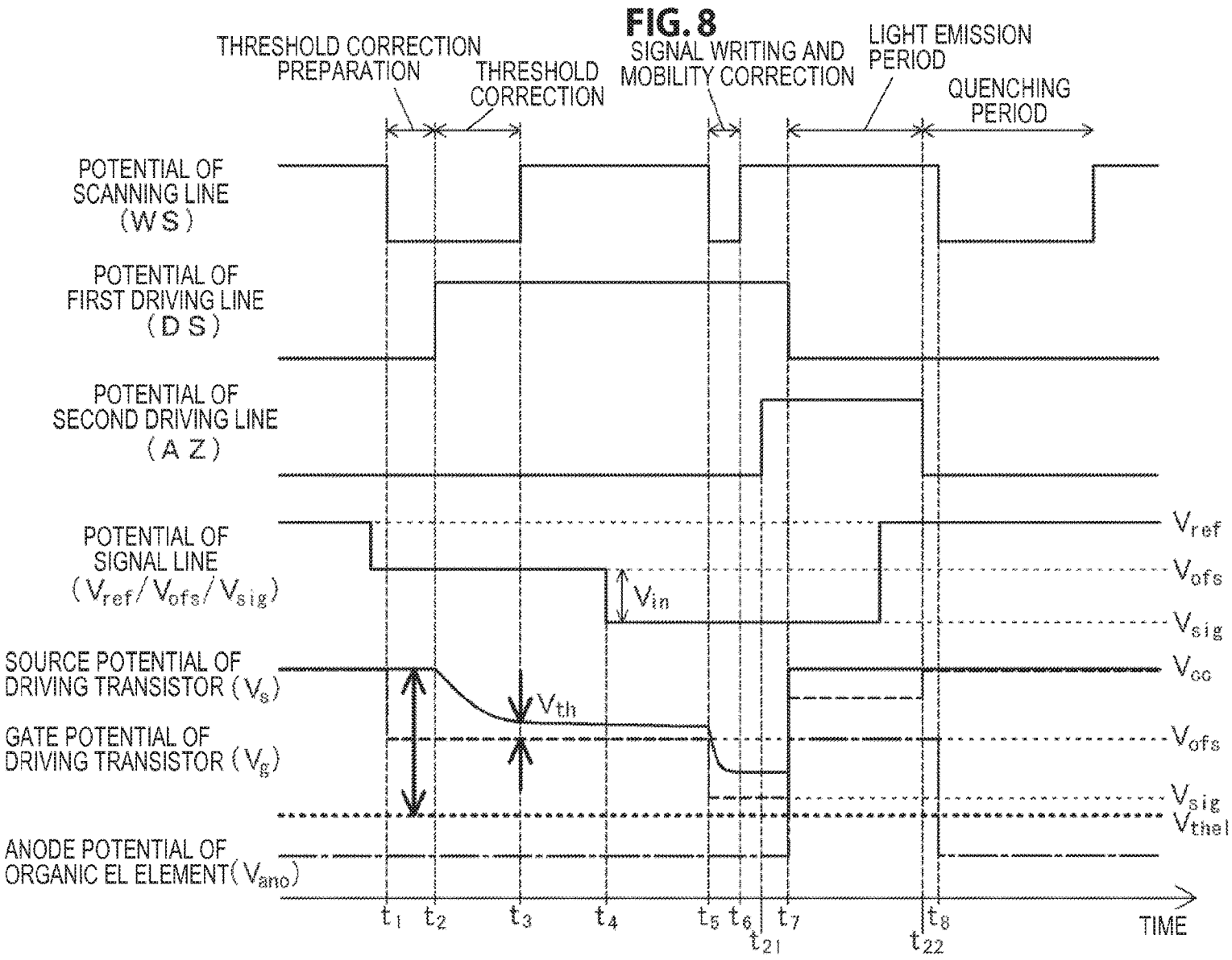
FIG. 8 is a timing waveform diagram for explaining a circuit operation of an active matrix display device according to Embodiment 3.

Embodiment 3 is the same as Embodiment 2 in terms of the circuit configuration of the pixel 20, and the use of the drive signal AZ as a drive signal for driving the switching transistor 27, and is different from Embodiment 2 in terms of a waveform (timing relation) of the drive signal AZ. Specifically, as shown in the timing waveform diagram of FIG. 8, the drive signal AZ is a signal which is in a non-active state only in a period from the time $t_{21}$ between the time $t_6$ and the time $t_7$, to the time $t_{22}$ before the time $t_8$.

Even when the drive signal AZ using such a waveform is used as the drive signal for the switching transistor 27, the same action and effect as is the case with Embodiment 2 can be obtained. That is, even when the threshold correction operation does not finish within the threshold correction period, the action of the switching transistor 27 can prevent a current from flowing in the organic EL element 21.

Note that, in a case of Embodiment 3, since the drive signal AZ is a signal which is in a non-active state only in the period from the time $t_{21}$ between the time $t_6$ to the time $t_7$, to the time $t_{22}$ before the time $t_8$, the start of quenching is determined by the timing (time $t_{22}$) when the drive signal AZ enters an active state. That is, the light emission period is set as a period from the time $t_7$ when the light emission control signal DS for driving the light emission control transistor 24 enters an active state, to the time $t_{22}$ when the drive signal AZ for driving the switching transistor 27 enters an active state.

3-4. Embodiment 4

Embodiment 4 is, similarly to a case of Embodiment 3, the same as Embodiment 2 in terms of the circuit configuration of the pixel 20, and the use of the drive signal AZ as a drive signal for driving the switching transistor 27, and is different from Embodiment 2 in terms of a waveform (timing relation) of the drive signal AZ. Specifically, as shown in the timing waveform diagram of FIG. 9, the timing relation indicates that the drive signal AZ enters a non-active state, that is, the switching transistor 27 enters a non-conductive state before the time $t_5$ when the signal writing period starts. The timing when the writing scanning signal enters an active state may be after the time $t_8$ as is the case with Embodiment 2, and may be before the time $t_8$ as is the case with Embodiment 3.

Embodiment 4 using the timing relation in which the drive signal AZ enters a non-active state before the signal writing period starts, can obtain an action and effect of suppressing burning degradation (deterioration) of the display panel 70 in addition to the action and effect as is the case with Embodiment 2. Here, the "burning" means, typically, a phenomenon that luminance of the light emission element constituting the display panel 70 partially deteriorates.

The light emission element (organic EL element 21 in this embodiment) constituting the display panel 70 has a characteristic of deteriorating in proportion to its light emission amount and light emission time. On the other hand, a content of an image displayed by the display panel 70 is not uniform. Therefore, in a case in which a fixed pattern is repeatedly displayed, such as a time display, for example, deterioration of the light emission element in a specific display region easily progresses. Then, the luminance of the light emission element in the specific display region in which the deterioration has progressed is relatively reduced compared with the luminance of the light emission element in the other display regions, leading to visible luminance unevenness. This local luminance deterioration of the light emission element means the burning degradation (deterioration).

Figure 10:
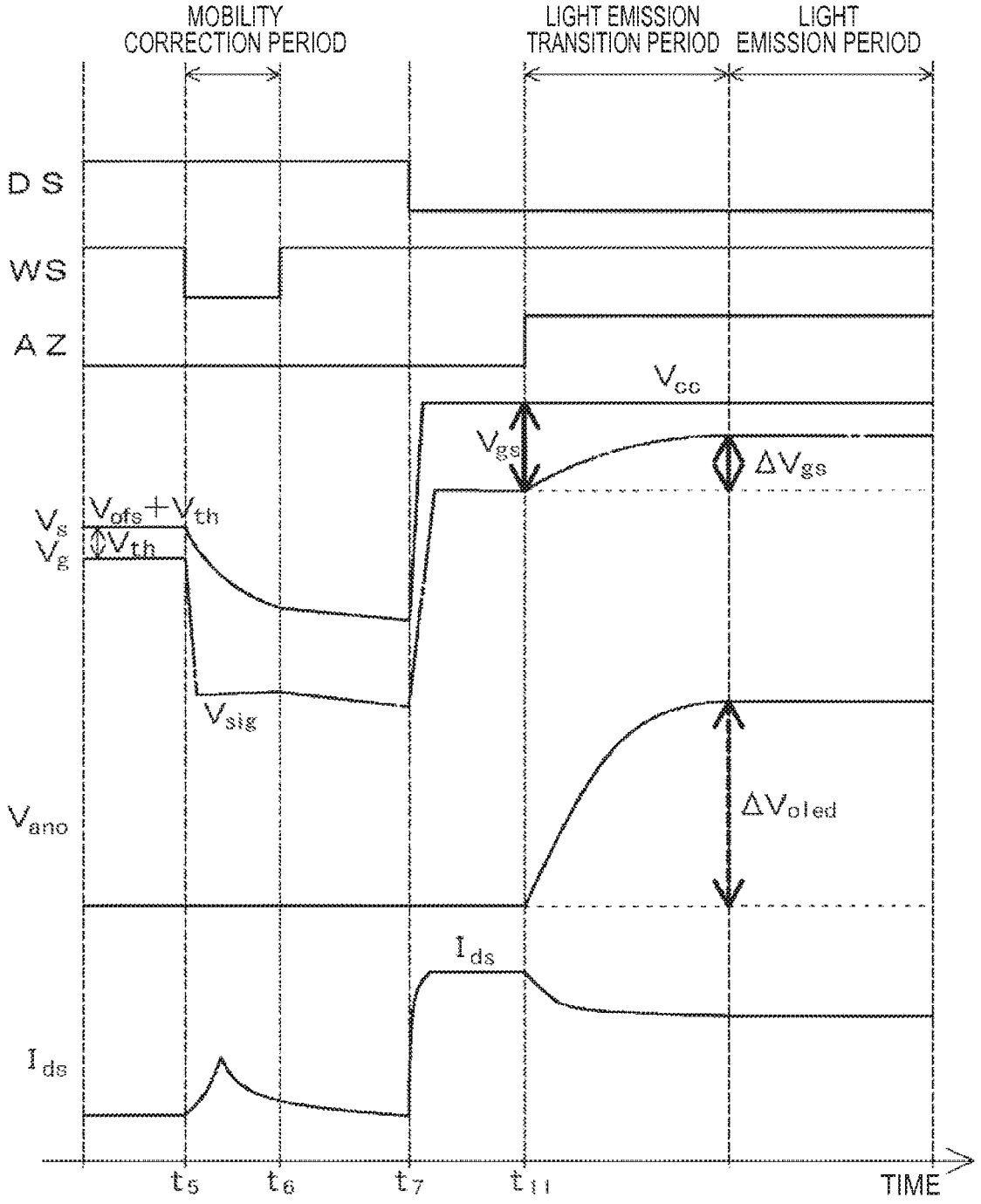
FIG. 10 is a timing waveform diagram focused on a light emission transition period before a light emission period starts.

Here, there will be described an operation of a light emission transition period before the light emission period starts. The timing waveform diagram focused on the light emission transition period is shown in FIG. 10. FIG. 10 shows a change in each of a light emission control signal DS, a writing scanning signal WS, a drive signal AZ, source potential $V_s$ and gate potential $V_g$ of the driving transistor 22, and anode potential $V_{ano}$ of the organic EL element 21, and a drain-source current $I_{ds}$ of the driving transistor 22.

Note that, in the timing waveform diagram of FIG. 10, the timing relation indicates that the drive signal AZ enters a non-active state after the time $t_7$ when the light emission control signal DS enters an active state. Then, when the drive signal AZ enters a non-active state at the time $t_{11}$ to bring the switching transistor 27 into a non-conductive state, the current supply from the drive transistor 22 to the organic EL element 21 is started to start the light emission transition period.

Figure 11:
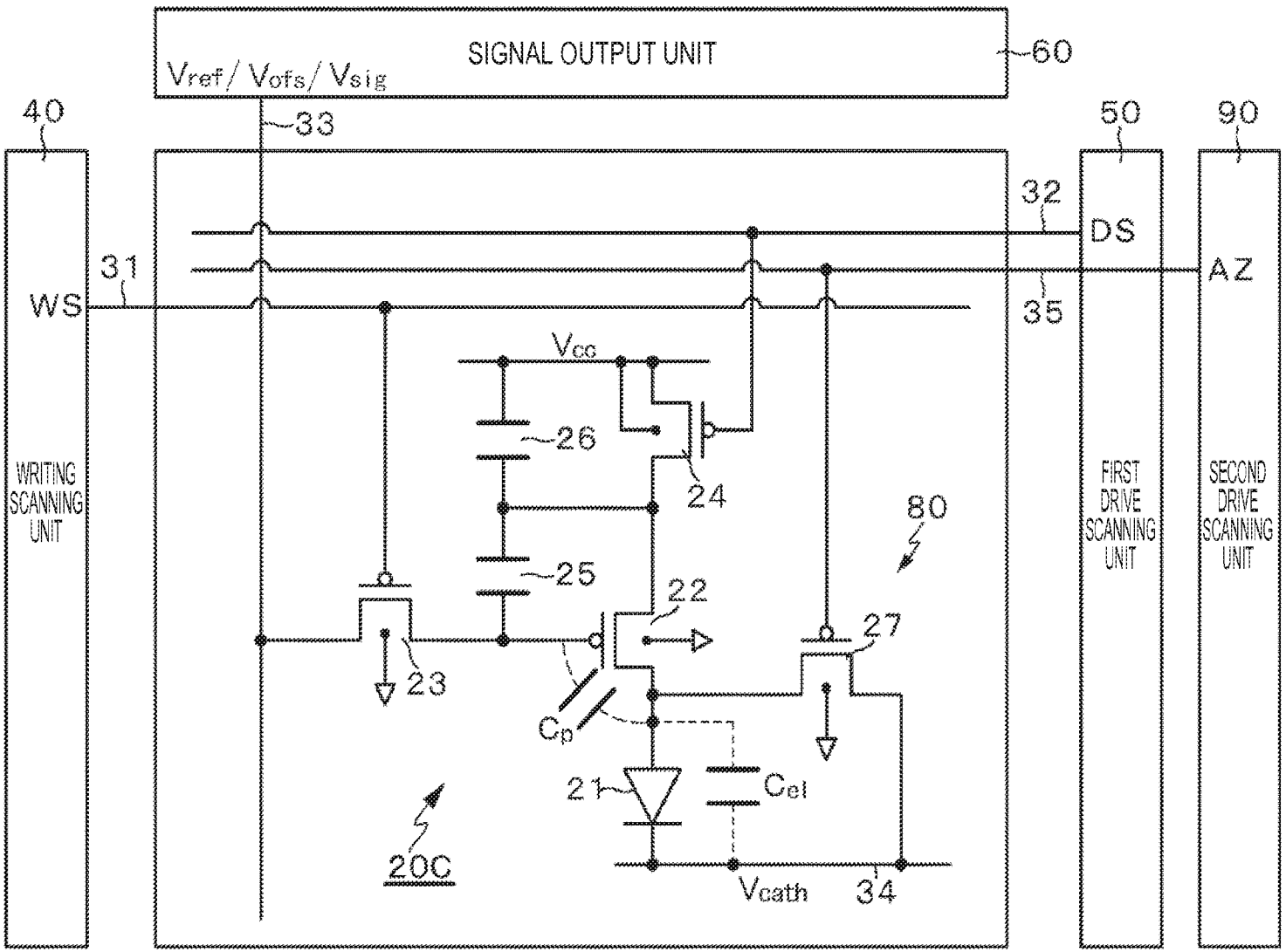
FIG. 11 is a circuit diagram showing a pixel (pixel circuit) including parasitic capacitance C existing between a gate electrode and a drain electrode of a driving transistor.

Meanwhile, the actual display panel 70, as shown in FIG. 11, has parasitic capacitance $C_p$ between the gate electrode and the drain electrode of the drive transistor 22. The presence of the parasitic capacitance $C_p$ causes a variation in the anode potential $V_{ano}$ of the organic EL element 21 in the light emission period to affect the gate potential $V_g$ of the driving transistor 22. This effect reduces the gate-source voltage $V_{gs}$ of the driving transistor 22 by $\Delta V_{gs}$, as shown in the timing waveform diagram of FIG. 10.

When a voltage applied to the organic EL element 21 at this time is $\Delta V_{oled}$, and a capacitance value of the holding capacitor 25 is $C_s$, $\Delta V_{gs}$ is given by Formula (1) as follows:

$$\Delta V_{gs}=C_p/(C_s+C_p)\times\Delta V_{oled} \quad (1)$$

Then, eventually, the driving transistor 22 enters a saturated state when the drain-source current $I_{ds}$ of the driving transistor 22 decreases, to start the light emission period.

The drain-source current $I_{ds}$ of the driving transistor 22 is given by Formula (2) as follows:

$$I_{ds}=(1/2)\times uC_{ox}\times W/L\times(V_{gs})^2 \quad (2)$$

Where W is a channel width of the driving transistor 22, L is a channel length, and $C_{ox}$ is gate capacitance per unit area.

The prolonged use deteriorates the organic EL element 21, causing a shift of an I-V characteristic (current-voltage characteristic) and a decrease in efficiency. FIG. 12A is a diagram showing an I-V characteristic before deterioration and after deterioration of the organic EL element 21, and FIG. 12B is a diagram showing an I-L characteristic (current-luminance characteristic) before deterioration and after deterioration of the organic EL element 21. In FIG. 12A and FIG. 12B, the broken line represents the characteristic before deterioration, and the solid line represents the characteristic after deterioration.

Figure 13:
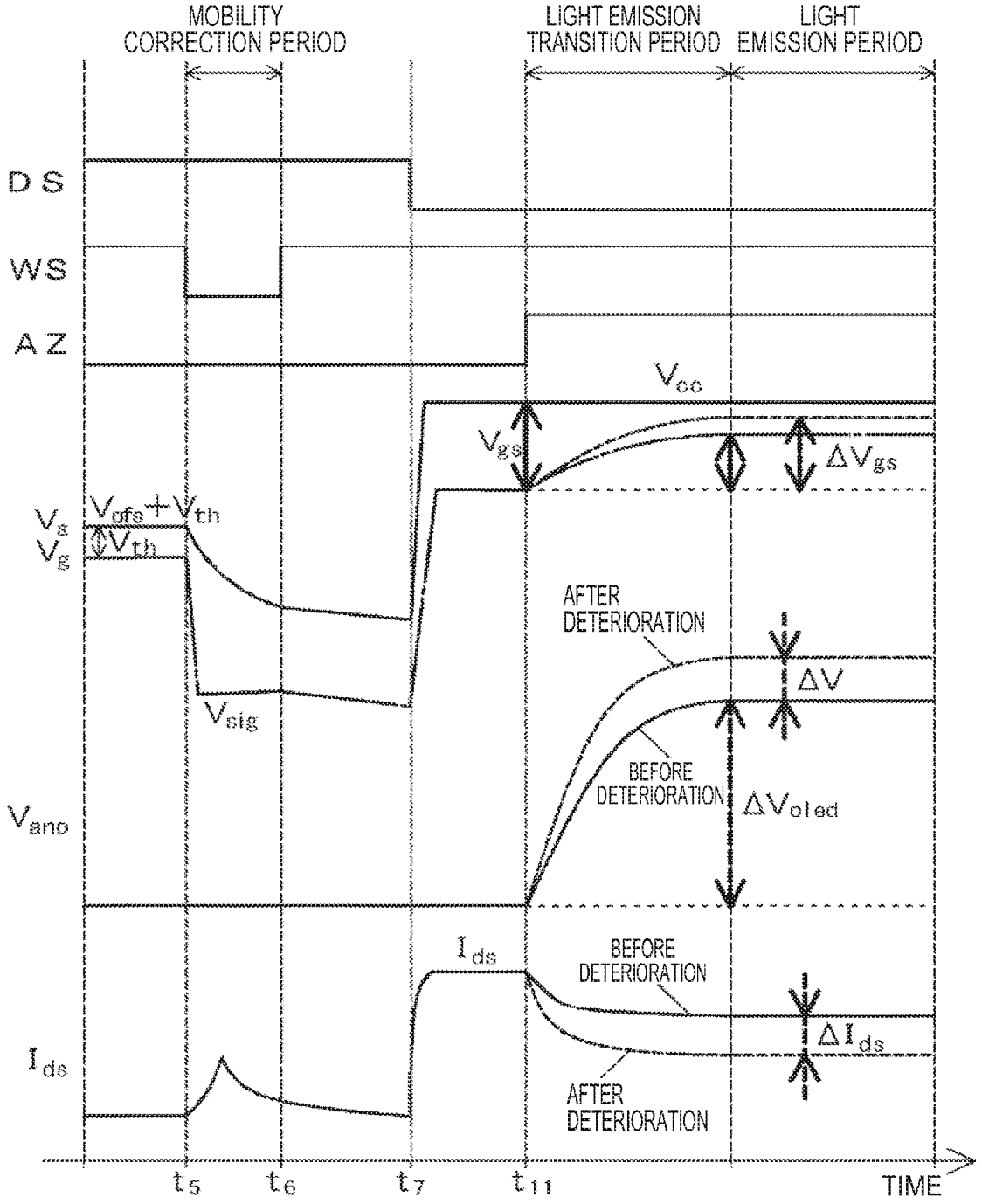
FIG. 13 is a timing waveform diagram focused on the light emission transition period before and after burning.

FIG. 13 is a timing waveform diagram focused on the light emission transition period before and after the burning. In FIG. 13, the broken line represents the waveform after deterioration, and the solid line represents the waveform before deterioration.

In the light emission transition period, in consideration of the effect of the shift of the I-V characteristic, it is necessary to need the anode potential $V_{ano}$ of the organic EL element 21 more as much as $\Delta V$ in order to obtain the same current. Since the voltage $\Delta V_{oled}$ of the organic EL element 21 further increases by the $\Delta V$ in the light emission period after the burning, the gate-source voltage $V_{gs}$ of the driving transistor 22 further decreases to reduce the drain-source current $I_{ds}$ of the driving transistor 22 by $\Delta I_{ds}$ less than that before the burning. In addition to the reduction in the efficiency of the organic EL element 21, the reduction in the current $I_{ds}$ causes the burning to degrade.

Embodiment 4 is made to suppress the burning degradation (deterioration) caused by the reduction in the current $I_{ds}$. Therefore, an active matrix display device according to Embodiment 4 applies, as shown in the timing waveform diagram of FIG. 9, the timing relation in which the drive signal AZ enters a non-active state, that is, the switching transistor 27 enters a non-active state before the signal writing period starts.

Figure 9:
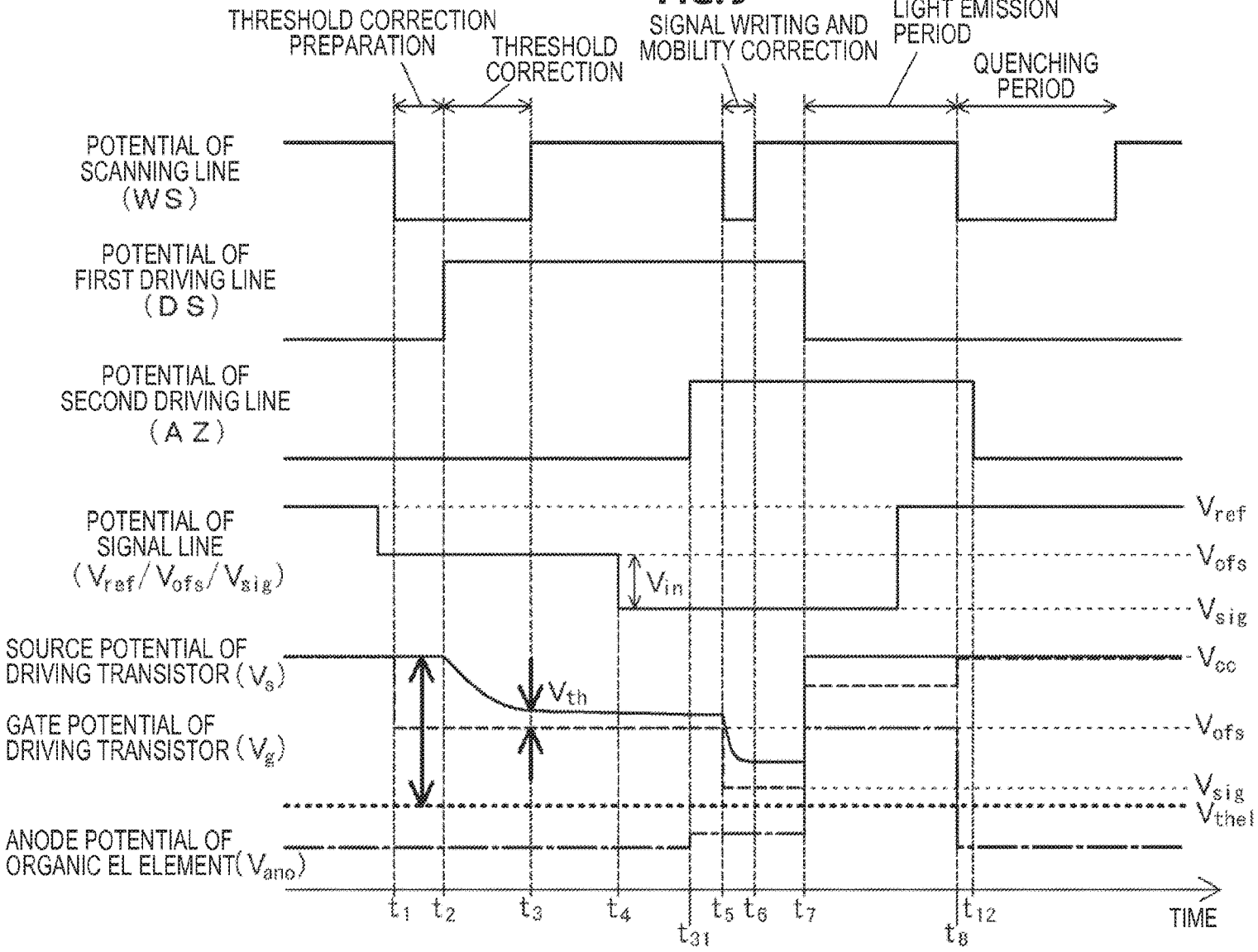
FIG. 9 is a timing waveform diagram for explaining a circuit operation of an active matrix display device according to Embodiment 4.

There will be described the circuit operation of the active matrix display device according to Embodiment 4, characterized by the above-described timing relation of the drive signal AZ, on the basis of the timing waveform diagram of FIG. 9.

In the threshold correction period from the time $t_2$ to the time $t_3$, in which the switching transistor 27 is in a conductive state, the drain-source current $I_{ds}$ of the driving transistor 22 flows to a side of the switching transistor 27, thereby preventing the organic EL element 21 from slightly emitting light. Then, since the threshold correction operation of the driving transistor 22 finishes before the signal writing, a voltage corresponding to the threshold voltage $V_{th}$ of the driving transistor 22 is held in the holding capacitor 25, and the driving transistor 22 is in a cut-off state.

After that, the drive signal AZ enters a non-active state at the time $t_{31}$ to bring the switching transistor 27 into a non-conductive state. Then, when the signal writing and mobility correction period from the time $t_5$ to the time $t_6$ starts, the signal voltage $V_{sig}$ of the image signal as a light emission signal from the signal line 33 is applied to the gate electrode of the driving transistor 22 by the writing by the sampling transistor 23.

At this time, when a capacitance value of the auxiliary capacitor 26 is $C_{sub}$, the gate-source voltage $V_{gs}$ of the driving transistor 22 is extended by an amount given by Formula (3) as follows:

$$V_{gs}=|V_{sig}-V_{ofs}|\times C_{sub}/(C_s+C_{sub})+V_{th}=a\times|V_{sig}-V_{ofs}|+V_{th} \quad (3)$$

When the gate-source voltage $V_{gs}$ of the driving transistor 22 is extended, a current flows in the driving transistor 22 to start the mobility correction operation. Since the switching transistor 27 is already in a non-conductive state in the signal writing and mobility correction processing, all the current flowing in the driving transistor 22 flows to a side of the organic EL element 21.

Here, the signal writing and mobility correction period from the time $t_5$ to the time $t_6$ has a period of a few hundreds [ns]. In addition, the drain-source current $I_{ds}$ flowing in the driving transistor 22 in the signal writing and mobility correction period is expressed by Formula (4) using the signal voltage $V_{sig}$ applied to the gate electrode of the driving transistor 22 as follows:

$$I_{ds}=\tfrac{1}{2}\times uC_{ox}\times W/L\times\{a\times|V_{sig}-V_{ofs}|\}^2 \quad (4)$$

The contrast of the display panel 70 is specified by black light emission luminance to white light emission luminance. The signal voltage $V_{sig}$ of the image signal on the black light emission is very small to cause the drain-source current $I_{ds}$ flowing in the driving transistor 22 in the mobility correction period to be very small, preventing the anode potential $V_{ano}$ of the organic EL element 21 from reaching the light emission threshold voltage $V_{thel}$. Therefore, the effect to the black light emission luminance is ignorable to eliminate a reduction in contrast.

A current flows in the organic EL element 21 in the mobility correction period. Accordingly, since the equivalent capacitor $C_{el}$ of the organic EL element 21 is charged according to the current $I_{ds}$ expressed by Formula (4) described above, the anode potential $V_{ano}$ of the organic EL element 21 increases. In the mobility correction period, the gate potential $V_g$ of the driving transistor 22 is fixed to the potential of the signal line 33, that is, the signal voltage $V_{sig}$ via the sampling transistor 23 in a conductive state, preventing an increase in the anode potential $V_{ano}$ of the organic EL element 21 from affecting the gate potential $V_g$.

After that, when the light emission control signal DS enters an active state at the time $t_7$ to bring the light emission control transistor 24 into a conductive state, the source potential $V_s$ of the driving transistor 22 is fixed to the power supply voltage $V_{cc}$ via the light emission control transistor 24. The driving transistor 22 thereby allows a light emission current to flow in the organic EL element 21. At this time, the equivalent capacitor $C_{el}$ of the organic EL element 21 is charged so that the anode potential $V_{ano}$ of the organic EL element 21 reached desired potential. Then, the driving transistor 22 reaches a saturated state when the gate-source voltage $V_{gs}$ of the driving transistor 22 becomes a certain voltage value, to start the light emission period.

Figure 14:
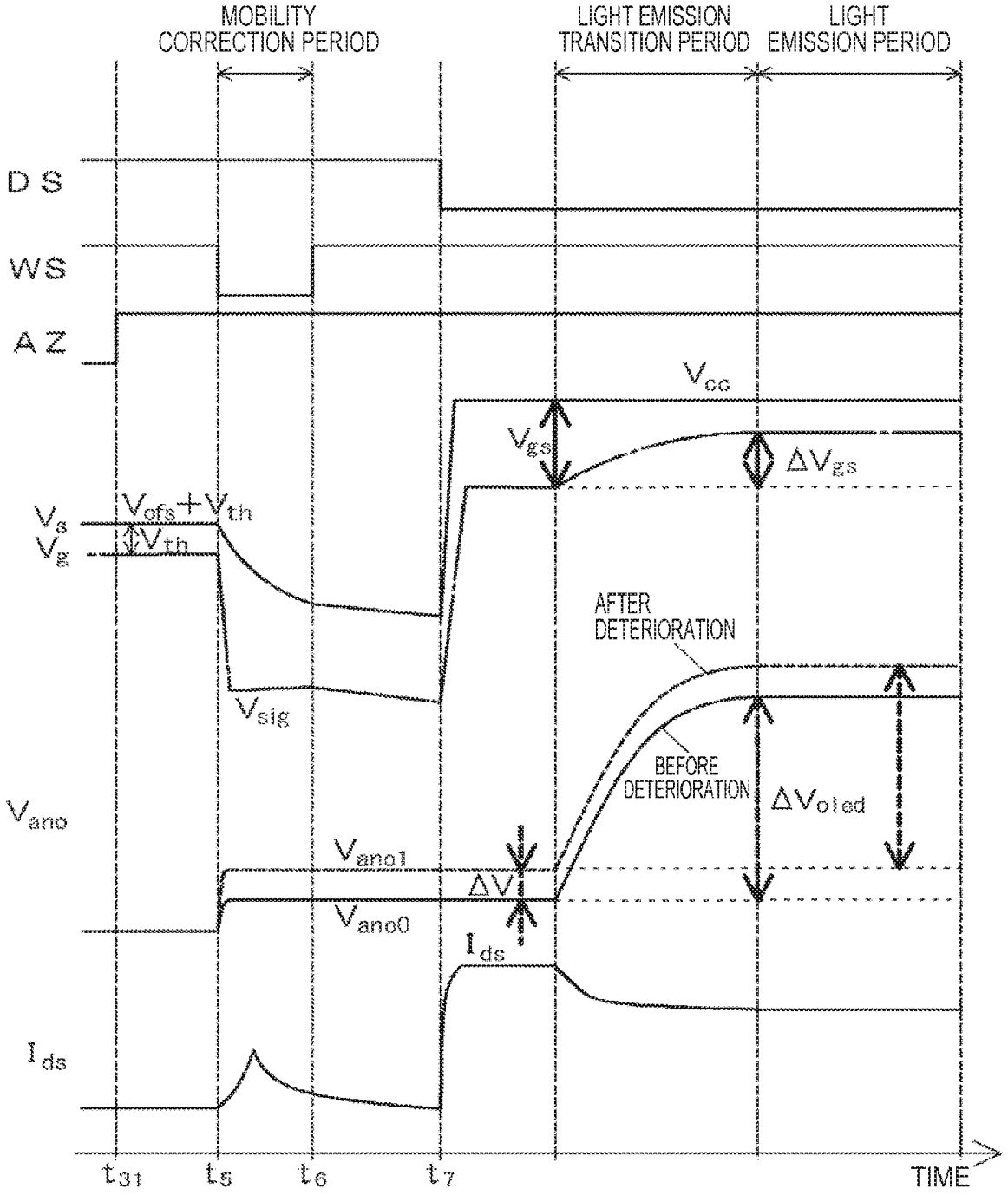
FIG. 14 is a timing waveform diagram focused on the light emission transition period before and after deterioration of the organic EL element after a long period of use.

Here, there will be described the operation of the organic EL element 21 used for a long time, before and after deterioration, by using the timing waveform diagram of FIG. 14. FIG. 14 is the timing waveform diagram focused on the light emission transition period before and after deterioration of the organic EL element after a long period of use. In FIG. 14, the broken line represents the waveform after deterioration, and the solid line represents the waveform before deterioration.

In the mobility correction period, as described above, the current (light emission current) flows in the organic EL element 21 according to the drain-source current $I_{ds}$. In this case, since the current $I_{ds}$ of the organic EL element 21 before and after deterioration depends on the gate-source voltage $V_{gs}$ of the driving transistor 22, the current is equal before and after deterioration. That is, when the current $I_{ds}$ before deterioration is $I_{ds1}$, and the current $I_{ds}$ after deterioration is $I_{ds2}$, $I_{ds1}=I_{ds2}$ is satisfied.

While the organic EL element 21 increases the anode potential $V_{ano}$ according to the respective currents $I_{ds1}$ and $I_{ds2}$, the organic EL element 21 after deterioration increases the anode potential $V_{ano}$ more as much as the shift portion $\Delta V$ of the I-V characteristic than the organic EL element 21 before deterioration. That is, when the anode potential $V_{ano}$ after deterioration is $V_{ano1}$, and the anode potential $V_{ano}$ before deterioration is $V_{oano0}$, $V_{ano1}=V_{ano0}+\Delta V$ is satisfied.

That is, the shift portion $\Delta V$ of the I-V characteristic as characteristic deterioration of the organic EL element 21 is accumulated in advance in the equivalent capacitor $C_{el}$ of the organic EL element 21, by bringing the switching transistor 27 into a non-conductive state before the signal writing period starts, and flowing a current in the organic EL element 21 in the mobility correction period. After that, in the light emission transition state, the desired voltage increase portion $\Delta V_{oled}$ becomes equal before and after deterioration. This prevents the occurrence of a reduction in the current $I_{ds}$ due to the burning, allowing the effect of the shift of the I-V characteristic of the organic EL element 21 to be corrected.

As described above, the effect of the shift of the I-V characteristic due to the deterioration of the organic EL element 21 can be corrected by setting the drive signal AZ to a non-active state before the signal writing period starts. This can suppress the burning degradation (deterioration) caused by the reduction in the current $I_{ds}$ while suppressing deterioration of contrast.

4. Application Example

The technology according to the present disclosure is not limited to the above-described embodiments, and various alterations and modifications may be possible within the scope of the present disclosure. For example, in the embodiments above described, there has been described, as an example, the case in which the technology according to the present disclosure is applied to the display device configured to form a P channel type transistor constituting the pixel 20 on a semiconductor substrate such as silicon, but it can be also applied to the display device configured to form the P channel type transistor constituting the pixel 20 on an insulating substrate such as a glass substrate.

5. Electronic Apparatus

The above described display device according to the present disclosure can be used for a display unit (display device) in an electronic apparatus in a variety of fields in which image signals inputted to the electronic apparatus or image signals generated within the electronic apparatus are displayed as an image or a moving image.

As is evident from the explanation of the embodiments described above, the display device according to the present disclosure can securely control the light emitting unit into a non-light emission state in the non-light emission period, thereby providing the display panel with high contrast. Therefore, in an electronic apparatus in a variety of fields, the display device according to the present disclosure can be used as a display unit thereof to achieve high contrast of the display unit.

Examples of the electronic apparatus in which the display device according to the present disclosure is used for a display unit include, in addition to a television system, a head-mounted display, a digital camera, a video camera, a game machine, a laptop personal computer, and the like. Further, the display device according to the present disclosure can also be used for a display unit in an electronic apparatus such as a mobile information apparatus including an electronic book device and an electronic watch, or a mobile communication device including a cell phone and a PDA.

Additionally, the present technology may also be configured as below.

[1]

A display device in which a pixel circuit is arranged, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential, the display device including:

a current path that flows a current flowing in the driving transistor in a non-light emission period of the light emitting unit into a predetermined node.

[2]

The display device according to [1], wherein the current path flows the current flowing in the driving transistor into a node of a cathode electrode of the light emitting unit.

[3]

The display device according to [2], wherein the current path includes a switching transistor that is connected between a drain electrode of the driving transistor and the node of the cathode electrode of the light emitting unit, and enters a conductive state in the non-light emission period of the light emitting unit.

[4]

The display device according to [3], wherein the switching transistor is driven by a signal for driving the sampling transistor.

[5]

The display device according to [3], wherein the switching transistor is driven by a signal different from a signal for driving the sampling transistor.

[6]

The display device according to [4] or [5], wherein a light emission period of the light emitting unit is set as a period from timing when a signal for driving the light emission control transistor becomes active, to timing when the signal for driving the sampling transistor becomes active.

[7]

The display device according to [5], wherein a light emission period of the light emitting unit is set as a period from timing when a signal for driving the light emission control transistor becomes active, to timing when the signal for driving the switching transistor becomes active.

[8]

The display device according to [5] or [7], wherein the signal for driving the switching transistor enters a non-active state before a writing period of the signal voltage by the sampling transistor starts.

[9]

The display device according to any of [1] to [8], wherein the sampling transistor, the light emission control transistor, and a switching transistor are configured with P channel type transistors.

[10]

The display device according to any of [1] to [9], wherein the pixel circuit performs an operation of changing source potential of the driving transistor toward potential obtained by subtracting a threshold voltage of the driving transistor from initial potential of gate potential of the driving transistor as a reference.

[11]

The display device according to any of [1] to [10], wherein the pixel circuit performs an operation of applying negative feedback to the holding capacitor in a writing period of the signal voltage by the sampling transistor by using a feedback amount according to a current flowing in the driving transistor.

[12]

A method for driving a display device, wherein a pixel circuit is arranged in the display device, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential, the method including:

flowing, when driving the display device, a current flowing in the driving transistor in a non-light emission period of the light emitting unit into a predetermined node.

[13]

An electronic apparatus including a display device in which a pixel circuit is arranged, the pixel circuit including a P channel type driving transistor that drives a light emitting unit, a sampling transistor that samples a signal voltage, a light emission control transistor that controls light emission/non-light emission of the light emitting unit, a holding capacitor that is connected between a gate electrode and a source electrode of the driving transistor, and holds the signal voltage written by the sampling by the sampling transistor, and an auxiliary capacitor that is connected between the source electrode of the driving transistor and a node having fixed potential, the display device including a current path that flows a current flowing in the driving transistor in a non-light emission period of the light emitting unit into a predetermined node.

REFERENCE SIGNS LIST

10 organic EL display device
20, $\mathbf{20}_A$, $\mathbf{20}_B$, $\mathbf{20}_C$ pixel (pixel circuit)
21 organic EL element
22 driving transistor
23 sampling transistor
24 light emission control transistor
25 holding capacitor
26 auxiliary capacitor
27 switching transistor
30 pixel array unit
31($\mathbf{31}_1$-$\mathbf{31}_m$) scanning line
32($\mathbf{32}_1$-$\mathbf{32}_m$) driving line
33($\mathbf{33}_1$-$\mathbf{33}_n$) signal line
34 common power supply line
40 writing scanning unit
50 driving scanning unit (first driving scanning unit)
60 signal output unit
70 display panel
80 current path
90 second driving scanning unit

The invention claimed is:

1. A display device comprising:

a plurality of pixel circuits, at least one pixel circuit of the plurality of pixel circuits including:

a light emitting element;

a P channel type first transistor;

a P channel type second transistor;

a P channel type third transistor;

a P channel type fourth transistor;

and a capacitance element, wherein a first terminal of the capacitance element is connected to a gate electrode of the second transistor, a second terminal of the capacitance element is connected to a first voltage line, the first transistor is configured to supply a data signal from a data signal line to the first terminal of the capacitance element when the first transistor is in an on state, the second transistor is configured to flow a driving current from the first voltage line to the light emitting element according to a voltage stored in the capacitance element, the second transistor and the third transistor are connected in series between the first voltage line and the light emitting element, the fourth transistor is connected between a second voltage line and an anode electrode of the light emitting element the fourth transistor is configured to cause a change from a light emission period of the light emitting element to a non-light emission period of the light emitting element at a timing when the fourth transistor enters a conductive state, and the third transistor is configured to enter into a non-conductive state for only a single instance during the non-light emission period, and to remain in the non-conductive state until an end of the non-light emission period.

2. The display device according to claim 1, wherein the first transistor is driven by a first signal, and the fourth transistor is driven by a second signal that is different from the first signal.

3. The display device according to claim 1, wherein the third transistor is driven by a third signal and the fourth transistor is driven by a second signal that is different from the third signal.

4. The display device according to claim 1, wherein the fourth transistor is configured to remain in the conductive state in at least a part of the non-light emission period of the light emitting element.

5. The display device according to claim 1, wherein the second transistor is configured to supply a compensation current to the capacitance element while the first transistor is in the on state.

6. The display device according to claim 1, wherein a cathode electrode of the light emitting element is connected to the second voltage line.

7. The display device according to claim 1, wherein a back gate electrode of the second transistor is connected to the first voltage line.

8. A method for driving a display device that includes a plurality of pixel circuits, at least one pixel circuit of the plurality of pixel circuits including a light emitting element, a first transistor, a second transistor, a third transistor, a fourth transistor, the first, second, third and fourth transistors being P channel type transistors, and a capacitance element, the method comprising:

supplying, through the first transistor, a data signal from a data signal line to a first terminal of the capacitance element when the first transistor is in an on state;

flowing, through the second transistor, a driving current from a first voltage line to the light emitting element according to a voltage stored in the capacitance element, wherein the first terminal of the capacitance element is connected to a gate electrode of the second transistor, a second terminal of the capacitance element is connected to a first voltage line, the second transistor and the third transistor are connected in series between the first voltage line and the light emitting element, the fourth transistor is connected between a second voltage line and an anode electrode of the light emitting element;

causing, by the fourth transistor, a change from a light emission period of the light emitting element to a non-light emission period of the light emitting element at a timing when the fourth transistor enters a conductive state; and causing the third transistor to enter into a non-conductive state for only a single instance during the non-light emission period, and to remain In the non-conductive state until an end of the non-light emission period.

9. The method according to claim 8, wherein the first transistor is driven by a first signal, and the fourth transistor is driven by a second signal that is different from the first signal.

10. The method according to claim 8, wherein the third transistor is driven by a third signal, and the fourth transistor is driven by a second signal that is different from the third signal.

11. The method according to claim 8, wherein the fourth transistor is configured to remain in the conductive state in at least a part of the non-light emission period of the light emitting element.

12. The method according to claim 8, wherein the second transistor is configured to supply a compensation current to the capacitance element while the first transistor is in the on state.

13. The method according to claim 8, wherein a back gate electrode of the second transistor is connected to the first voltage line.

14. An electronic apparatus, comprising:

a plurality of pixel circuits, at least one pixel circuit of the plurality of pixel circuits including:

a light emitting element;

a P channel type first transistor;

a P channel type second transistor;

a P channel type third transistor;

a P channel type fourth transistor;

and a capacitance element, wherein a first terminal of the capacitance element is connected to a gate electrode of the second transistor, a second terminal of the capacitance element is connected to first voltage line, the first transistor is configured to supply a data signal from a data signal line to the first terminal of the capacitive element when the first transistor is in an on state, the second transistor is configured to flow a driving current from the first voltage line to the light emitting element according to a voltage stored in the capacitance element, the second transistor and the third transistor are connected in series between the first voltage line and the light emitting element, the fourth transistor is connected between a second voltage line and an anode electrode of the light emitting element, the fourth transistor is configured to cause a change from a light emission period of the light emitting element to a non-light emission period of the light emitting element at a timing when the fourth transistor enters a conductive state, and the third transistor is configured to enter into a non-conductive state for only a single instance during the non-light emission period, and to remain in the non-conductive state until an end of the non light emission period.

15. The electronic apparatus according to claim 14, wherein the first transistor is driven by a first signal, and the fourth transistor is driven by a second signal that is different from the first signal.

16. The electronic apparatus according to claim 14, wherein the third transistor is driven by a third signal and the fourth transistor is driven by a second signal that is different from the third signal.

17. The electronic apparatus according to claim 14, wherein the fourth transistor is configured to remain in the conductive state in at least a part of the non-light emission period of the light emitting element.

18. The electronic apparatus according to claim 14, wherein the second transistor is configured to supply a compensation current to the capacitance element while the first transistor is in the on state.

19. The electronic apparatus according to claim 14, wherein a cathode electrode of the light emitting element is connected to the second voltage line.

20. The electronic apparatus according to claim 14, wherein a back gate electrode of the second transistor is connected to the first voltage line.

* * * * *